US010801388B2

(12) United States Patent
Culbertson et al.

(10) Patent No.: US 10,801,388 B2
(45) Date of Patent: Oct. 13, 2020

(54) EXHAUST GAS HEATING APPARATUS

(71) Applicant: Watlow Electric Manufacturing Company, St. Louis, MO (US)

(72) Inventors: David P. Culbertson, Richmond, IL (US); Richard T. Williams, Jr., Richmond, IL (US); Christopher Meyers, Richmond, IL (US); Jeremy Ohse, Richmond, IL (US); Mark Everly, Richmond, IL (US); Roger Brummell, Hannibal, MO (US); Gerald S. Jackson, Hannibal, MO (US); Jake Spooler, Hannibal, MO (US); James N. Pradun, Hannibal, MO (US); Scott H. Boehmer, Hannibal, MO (US); Mitchell T. Diaco, Richmond, IL (US); Robert K. Frake, Winona, MN (US)

(73) Assignee: Watlow Electric Manufacturing Company, St. Louis, MO (US)

( * ) Notice: Subject to any disclaimer, the term of this patent is extended or adjusted under 35 U.S.C. 154(b) by 943 days.

(21) Appl. No.: 14/132,462

(22) Filed: Dec. 18, 2013

(65) Prior Publication Data

US 2014/0190151 A1 Jul. 10, 2014

Related U.S. Application Data

(60) Provisional application No. 61/738,923, filed on Dec. 18, 2012, provisional application No. 61/888,726, filed on Oct. 9, 2013.

(51) Int. Cl.
*F01N 3/26* (2006.01)
*F01N 13/00* (2010.01)
(Continued)

(52) U.S. Cl.
CPC ..... *F01N 3/26* (2013.01); *F01N 3/027* (2013.01); *F01N 13/008* (2013.01); *F23G 7/063* (2013.01);
(Continued)

(58) Field of Classification Search
CPC ... F02M 1/00; F02M 2700/435; F02M 31/135
(Continued)

(56) References Cited

U.S. PATENT DOCUMENTS 1,366,519 A 1/1921 Carmean
1,763,160 A * 6/1930 Knight ..... H02G 3/081 220/3.94
(Continued)

FOREIGN PATENT DOCUMENTS

JP U6078918 1/1985
JP 04164115 6/1992
(Continued)

OTHER PUBLICATIONS

Machine Translation of JP09-032533; Jun. 2020 (Year: 2020).*
International Search Report and Written Opinion of PCT/US2013/076008; dated Mar. 20, 2014.

*Primary Examiner* — Tu B Hoang
*Assistant Examiner* — Thomas J Ward
(74) *Attorney, Agent, or Firm* — Burris Law, PLLC

(57) ABSTRACT

A heating apparatus and method for use in an exhaust gas system is provided that includes a container body defining an exhaust gas pathway, a heater flange component attached to an exterior of the container body, and a heater assembly disposed in the exhaust gas pathway and secured to the heater flange component. The heater assembly includes at least one heater element, a bracket assembly that secures the at least one heater element in the container body, and a
(Continued)

conformal bracket for securing the at least one heater element to the bracket assembly.

23 Claims, 41 Drawing Sheets

(51) Int. Cl.

| | |
|---|---|
| ***F23G 7/06*** | (2006.01) |
| ***F23J 15/08*** | (2006.01) |
| ***F24H 3/04*** | (2006.01) |
| ***F01N 3/027*** | (2006.01) |
| ***F24H 9/18*** | (2006.01) |
| ***H05B 1/02*** | (2006.01) |
| ***H05B 3/44*** | (2006.01) |

(52) U.S. Cl.
CPC ..... *F23J 15/08* (2013.01); *F24H 3/0405* (2013.01); *F24H 9/1818* (2013.01); *H05B 1/0236* (2013.01); *H05B 3/44* (2013.01); *F01N 2240/16* (2013.01); *F01N 2560/06* (2013.01); *F23G 2900/508* (2013.01); *F24H 2250/02* (2013.01)

(58) Field of Classification Search
USPC ..... 219/206, 532; 392/350, 360, 370; 60/303
See application file for complete search history.

(56) References Cited

U.S. PATENT DOCUMENTS

| | | | | |
|---|---|---|---|---|
| 3,102,185 | A | 8/1963 | Boyd et al. | |
| 3,149,029 | A * | 9/1964 | Stevenson | D21F 1/523 162/352 |
| 3,176,117 | A * | 3/1965 | Knoll | F24H 3/0411 165/121 |
| 4,548,625 | A * | 10/1985 | Ishida | F01N 3/027 422/178 |
| 4,723,973 | A * | 2/1988 | Oyobe | F01N 3/027 219/552 |
| 5,293,742 | A | 3/1994 | Gillingham et al. | |
| 6,874,512 | B2 * | 4/2005 | Publ | B08B 3/006 134/105 |
| 2005/0005773 | A1 | 1/2005 | Shutty et al. | |
| 2006/0118545 | A1 | 6/2006 | Sherrill et al. | |
| 2008/0028753 | A1 | 2/2008 | Wagner et al. | |

FOREIGN PATENT DOCUMENTS

| | | | | |
|---|---|---|---|---|
| JP | 09-032533 | * | 2/1997 | H05B 3/68 |
| JP | 932533 | | 2/1997 | |
| JP | 2001317340 | | 4/2000 | |
| JP | 2002295236 | | 10/2002 | |

* cited by examiner

EXHAUST GAS HEATING APPARATUS

CROSS-REFERENCE TO RELATED APPLICATIONS

The present application claims the benefit of U.S. Provisional Application No. 61/738,923, filed on Dec. 18, 2012, titled "Electric Heaters for Heating Exhaust Gases" and U.S. Provisional Application No. 61/888,726, filed on Oct. 9, 2013, titled "Improved Exhaust Gas Heating Apparatus." The content of the above-referenced applications are incorporated herein by reference in their entirety.

FIELD

The present application relates to exhaust systems for internal combustion engines, and more specifically to exhaust gas heating apparatuses installed in the exhaust systems.

BACKGROUND

The statements in this section merely provide background information related to the present disclosure and may not constitute prior art.

Heater systems are used in exhaust systems that are coupled to an internal combustion engine in order to assist in the reduction of the undesirable release of various gases and other pollutant emissions into the atmosphere. These exhaust systems typically include various after-treatment devices, such as diesel particulate filters (DPF); a catalytic converter; selective catalytic reducers (SCR) that capture carbon monoxide (CO), nitrogen oxides ($NO_x$), particulate matters (PMs), and unburned hydrocarbons (HCs) contained in the exhaust gas; a diesel oxidation catalyst (DOC); a lean $NO_x$ trap (LNT); an ammonia slip catalyst; or reformers, among others. The heaters may be activated periodically or at a predetermined time to increase the exhaust temperature and activate the catalysts and/or to burn the particulate matters or unburned hydrocarbons that have been captured in the exhaust system.

The electric heaters are generally installed in exhaust pipes or components such as containers of the exhaust system and are subjected to harsh environmental conditions, such as vibration, mechanical shock, temperature cycling, high heat, etc.

SUMMARY

In one form of the present disclosure, a heating apparatus for an exhaust gas system is provided that comprises a container body defining an exhaust gas pathway, a heater flange component attached to an exterior of the container body, and a heater assembly disposed in the exhaust gas pathway and secured to the heater flange component. The heater assembly includes at least one heater element, a bracket assembly that secures the at least one heater element in the container body, and a conformal bracket for securing the at least one heater element to the bracket assembly.

In another form, a heater assembly for a thermal management application is provided that comprises at least one heater element, a bracket assembly that secures the at least one heater element to a component of the thermal management application, a flow diverter secured to the bracket assembly, and a conformal bracket for securing the at least one heater element to the bracket assembly. The heater element and flow diverter are exposed to a thermal flow during operation.

In still another form, a method of heating and diverting a thermal flow using the heating apparatus in its various forms are provided by the present disclosure.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 10A:
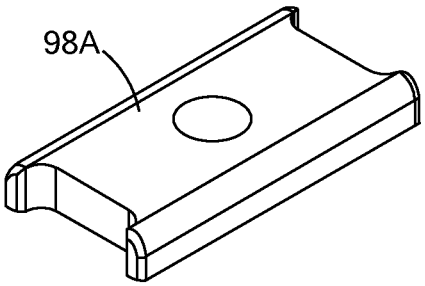
Figure 10B:
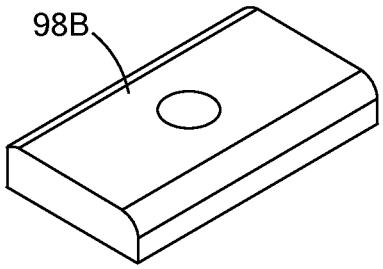
Figure 10C:
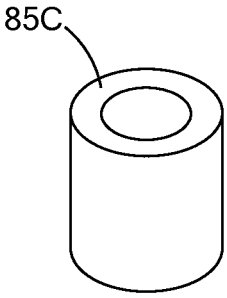
Figure 10D:
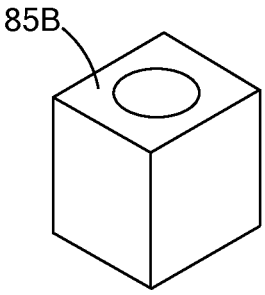
Figure 10E:
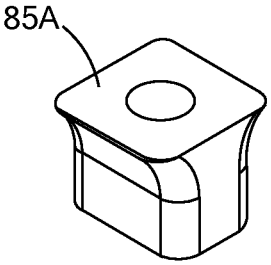
Figure 11:
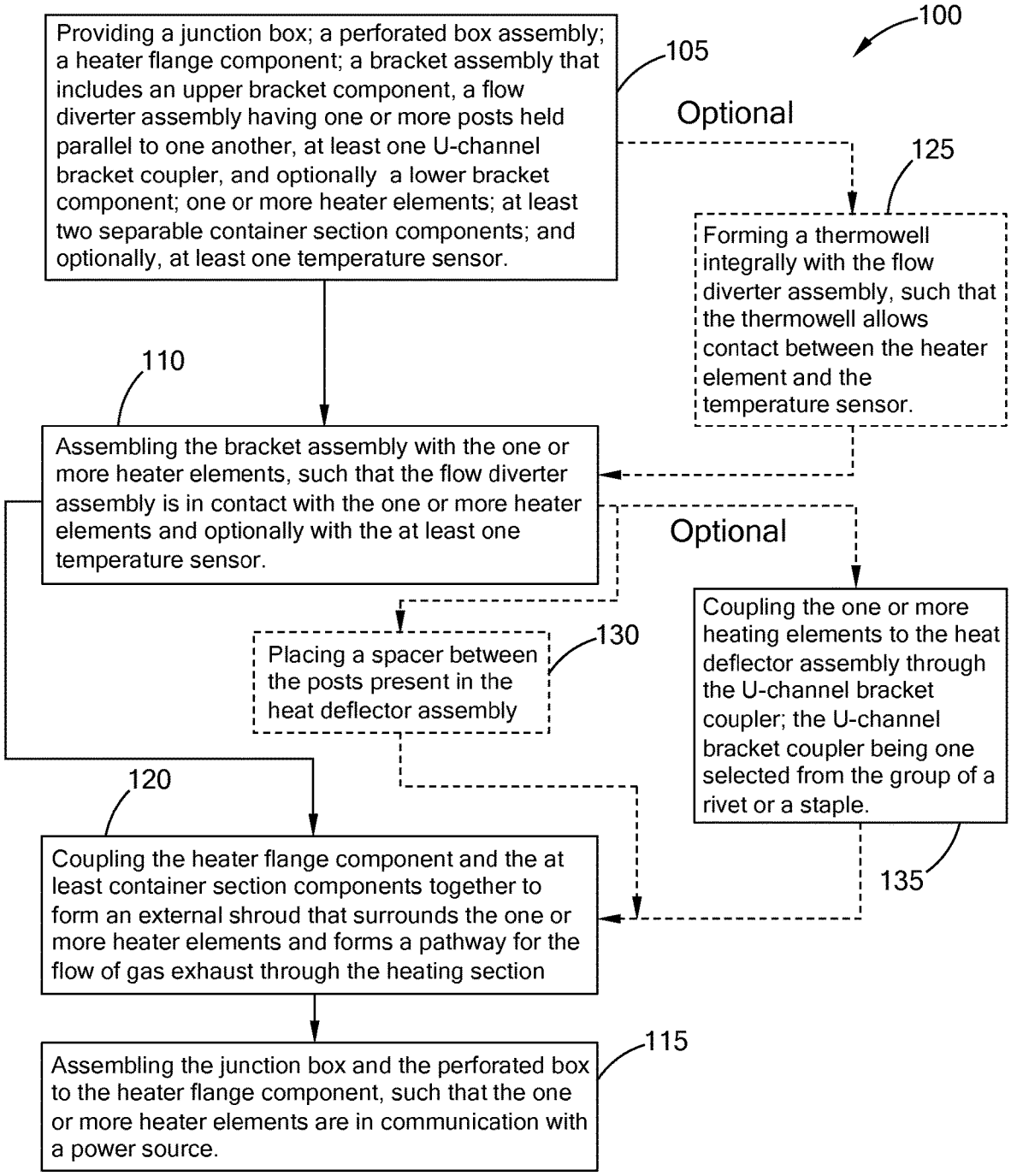
Figure 12A:
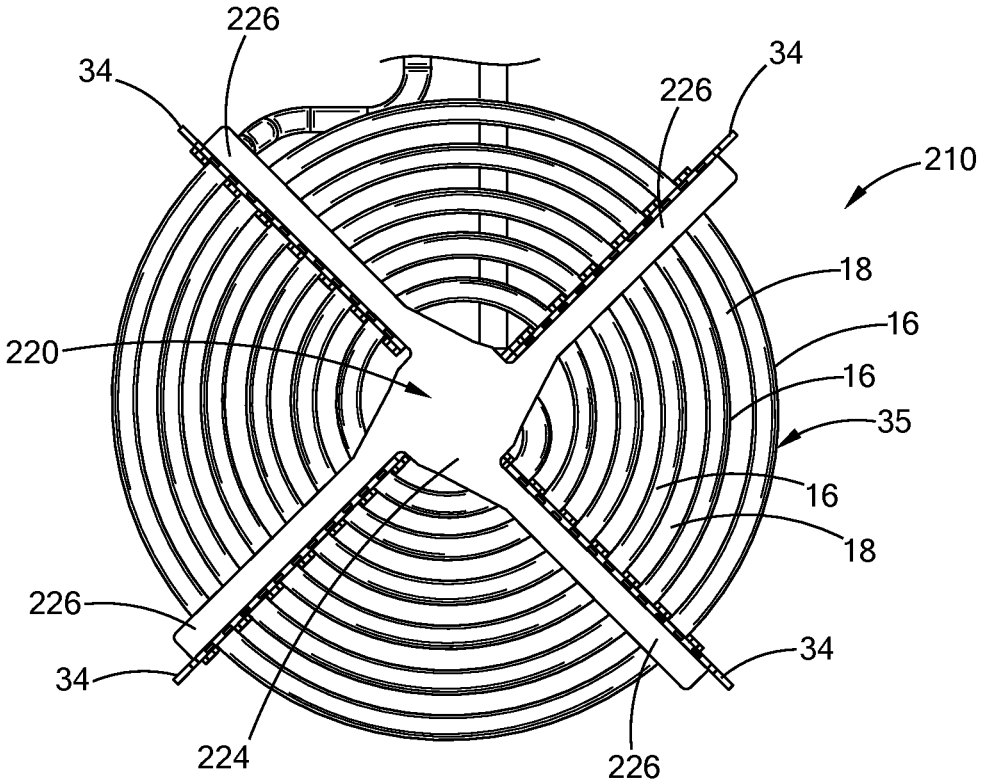
Figure 12B:
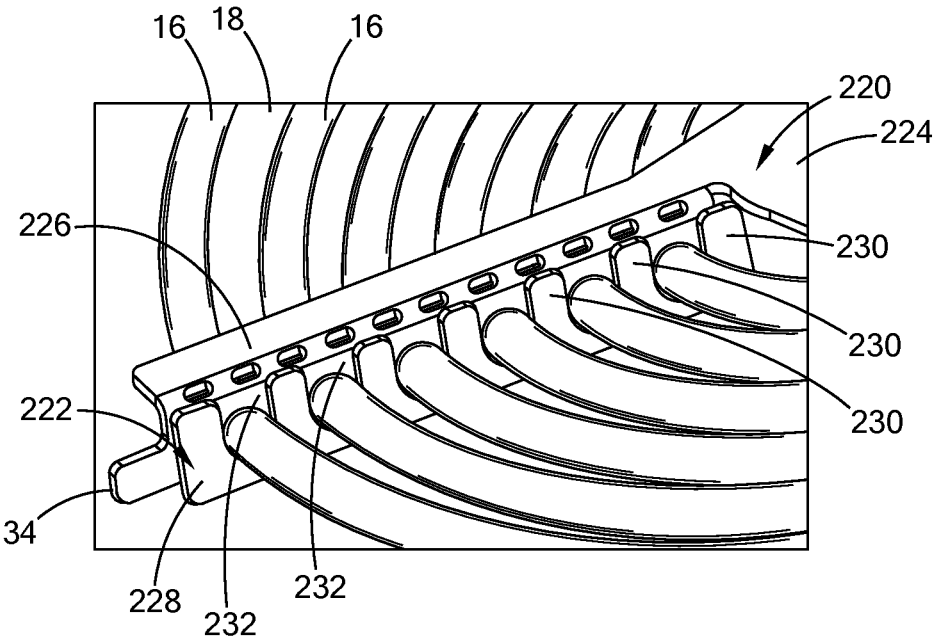
Figure 13A:
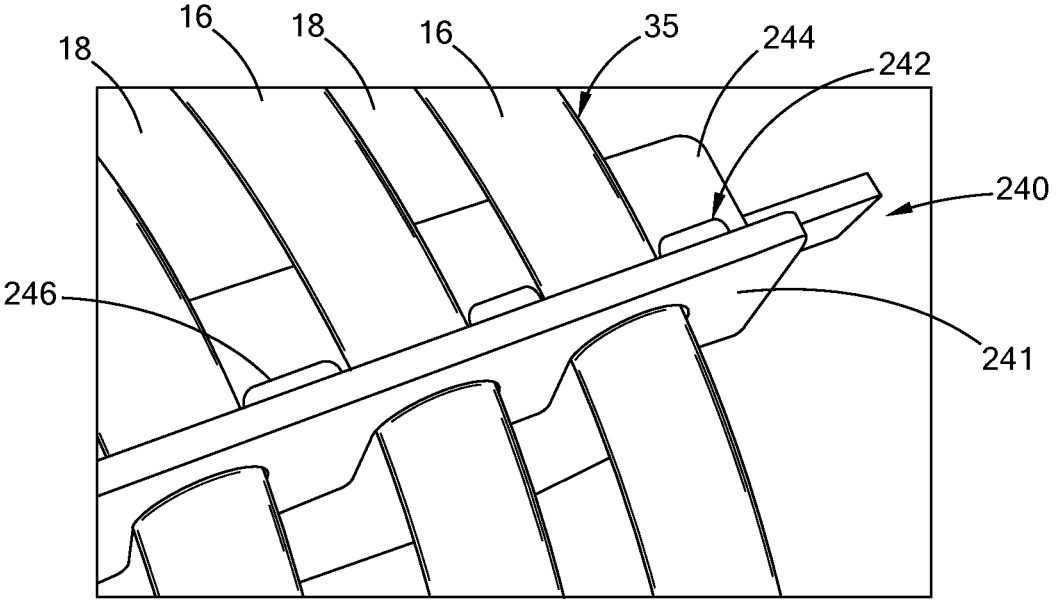
Figure 13B:
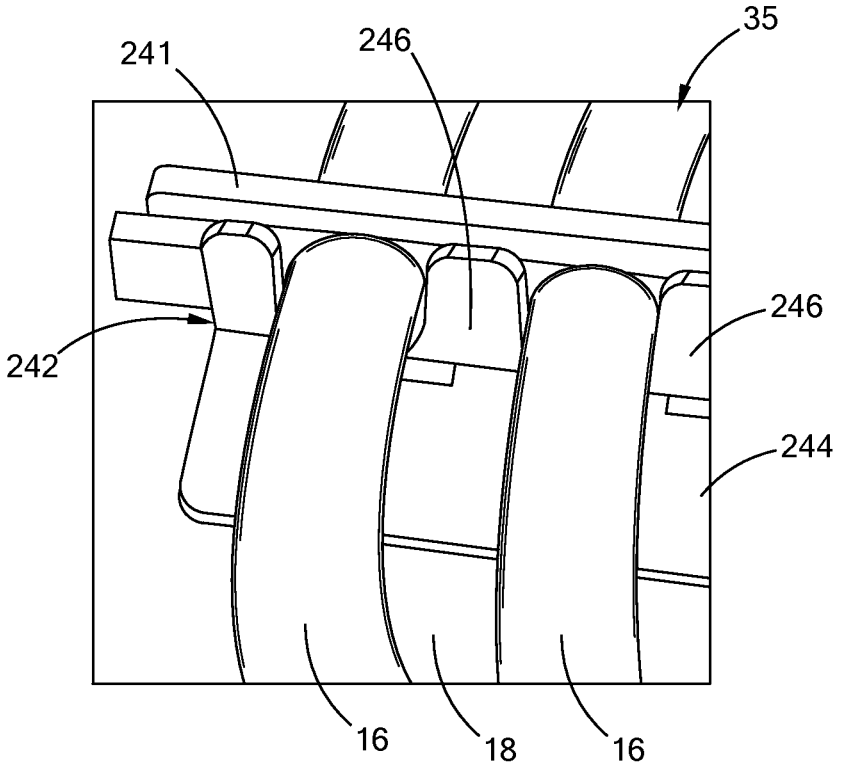
Figure 14A:
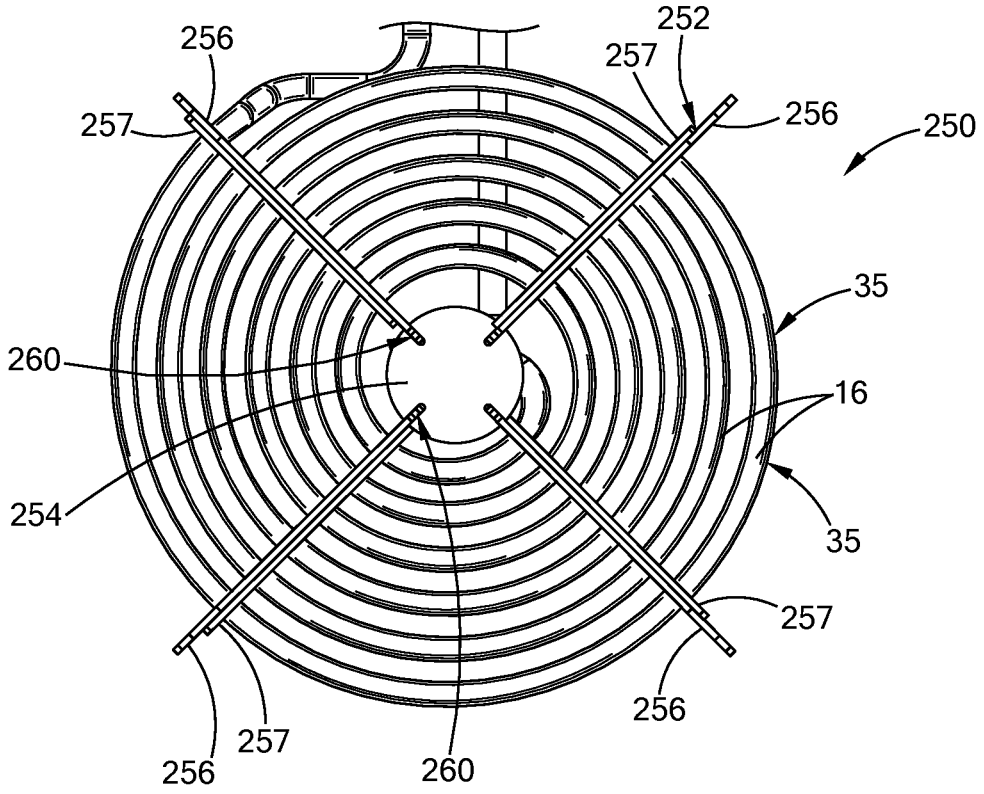
Figure 14B:
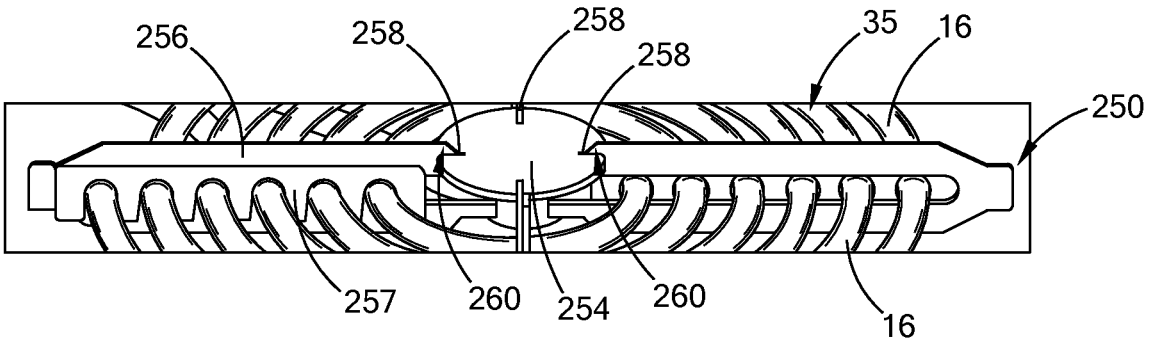
Figure 15:
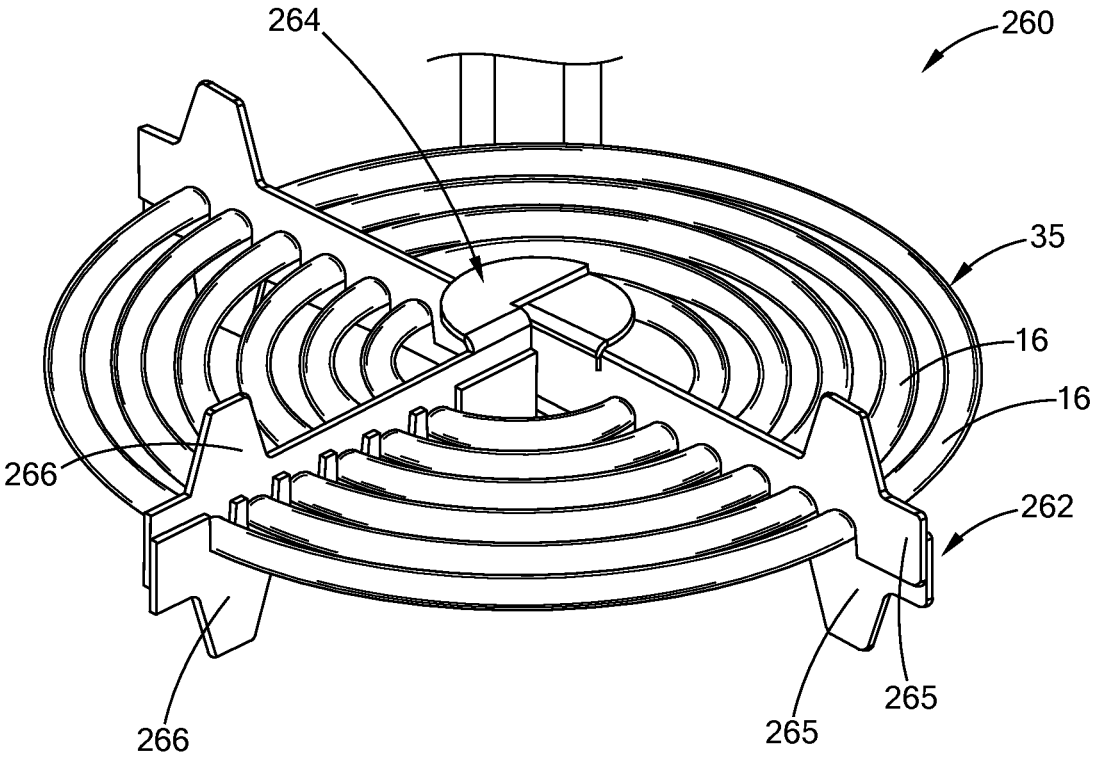
Figure 16A:
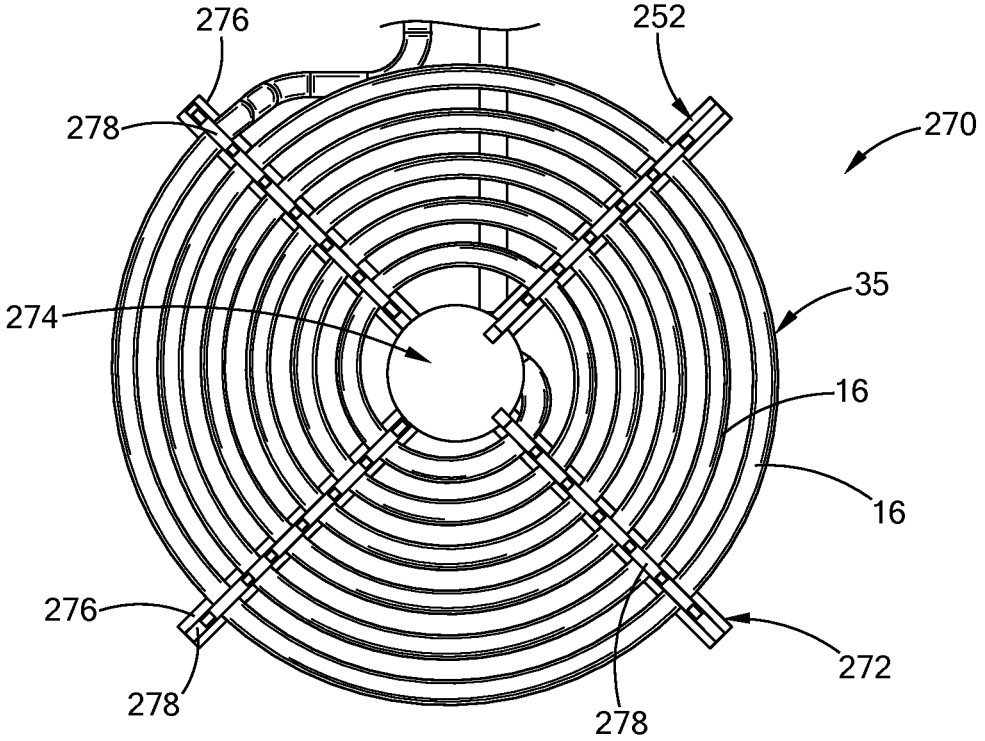
Figure 16B:
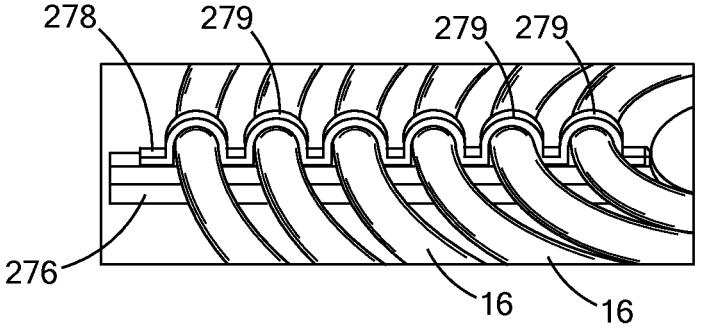
Figure 16C:
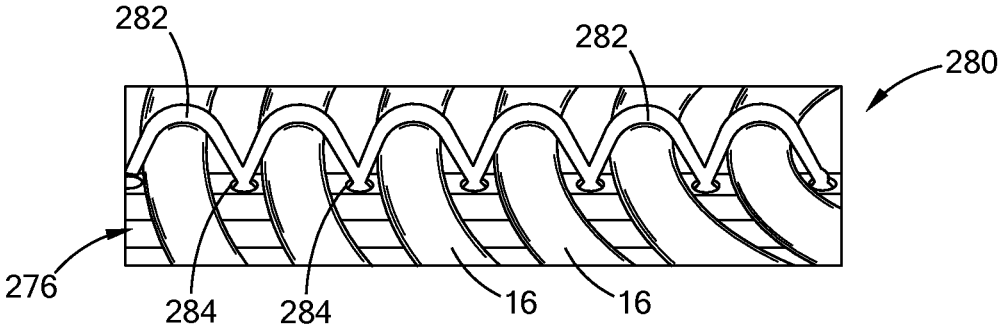
Figure 16D:
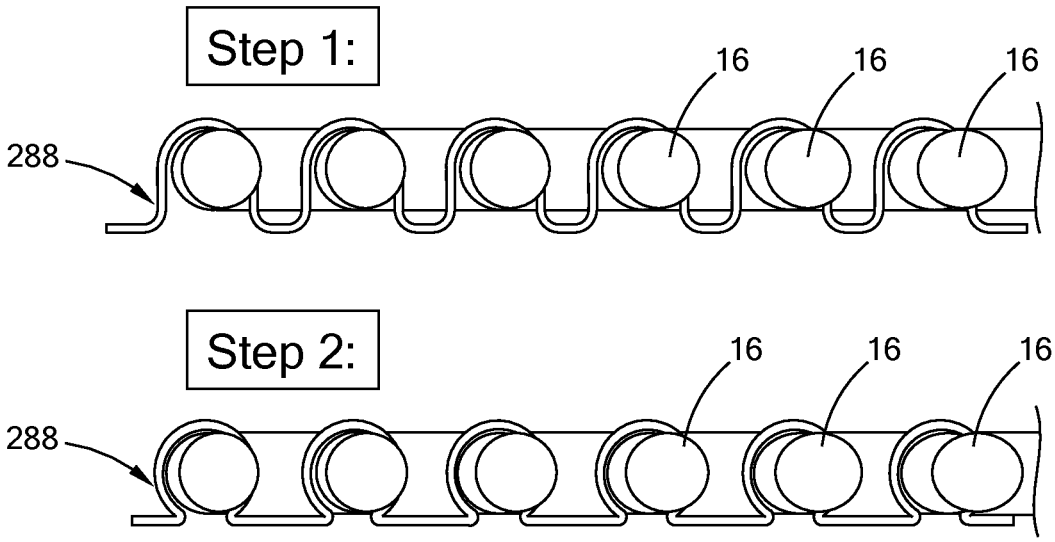
Figure 16E:
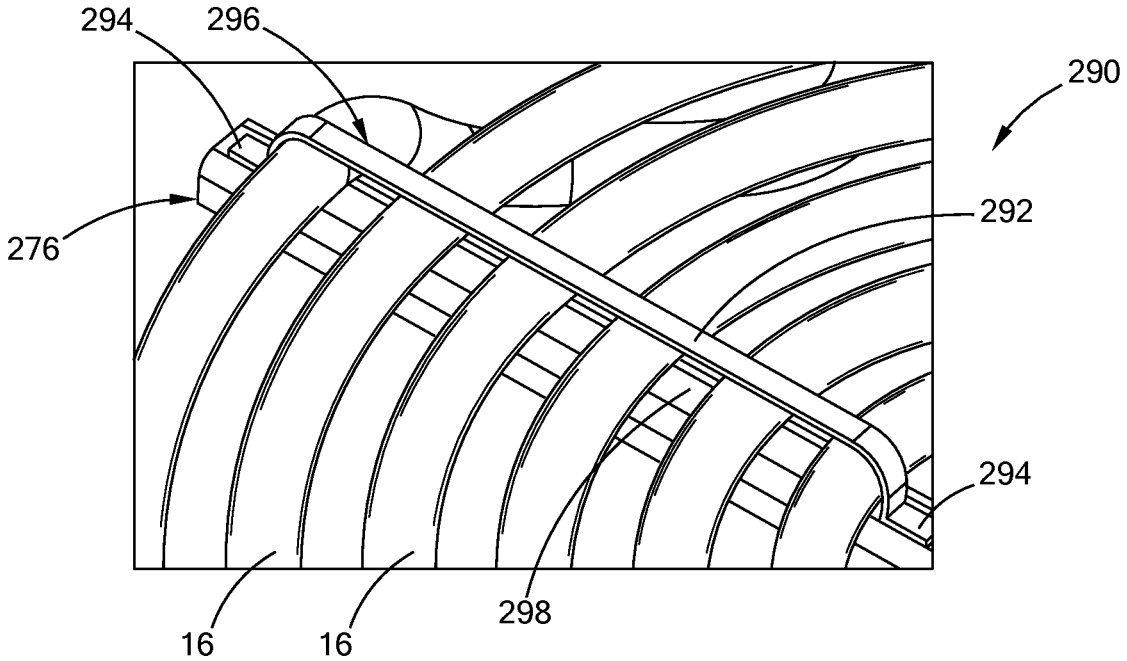
Figure 17A:
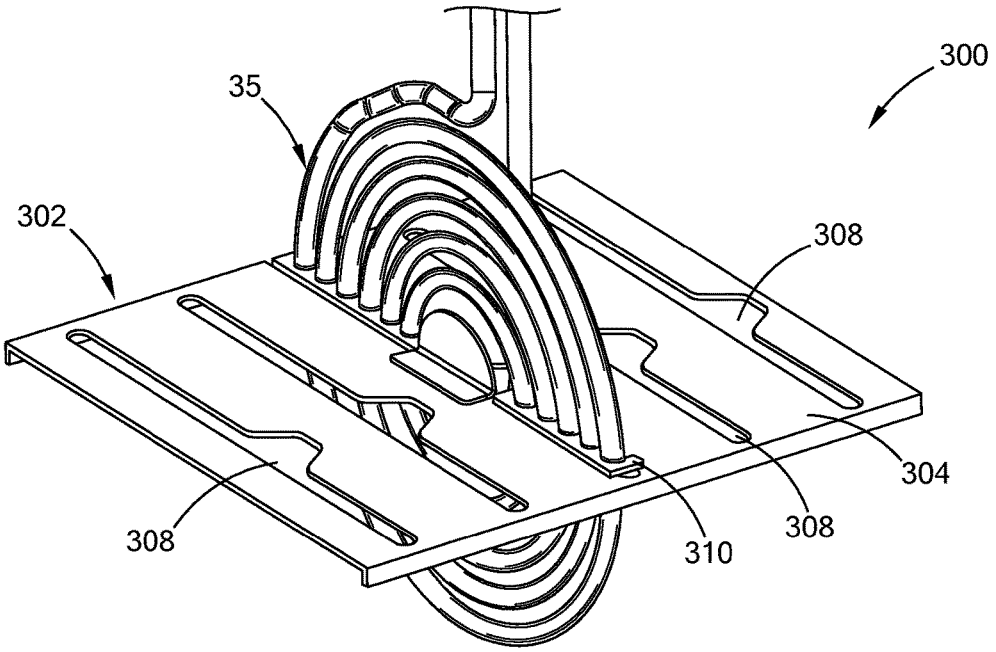
Figure 17B:
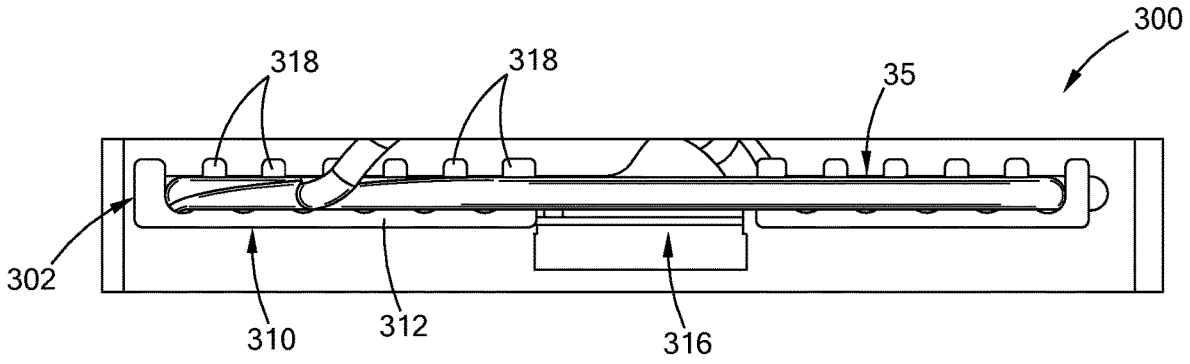
Figure 17C:
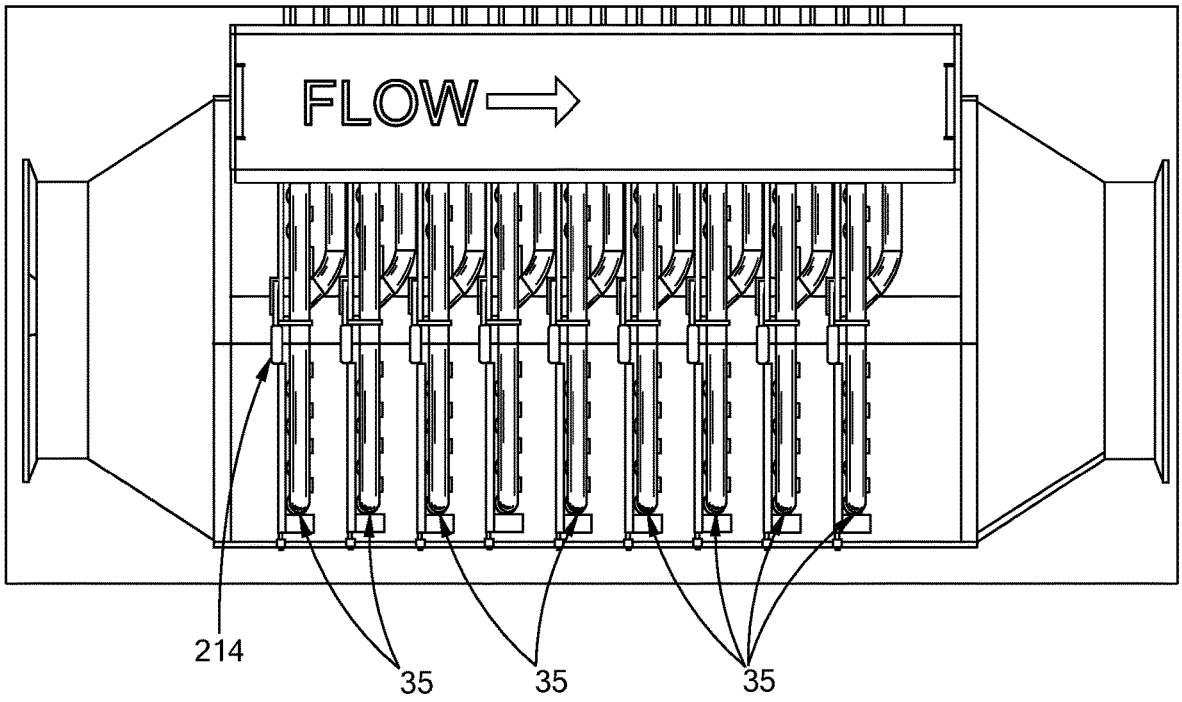
Figure 17D:
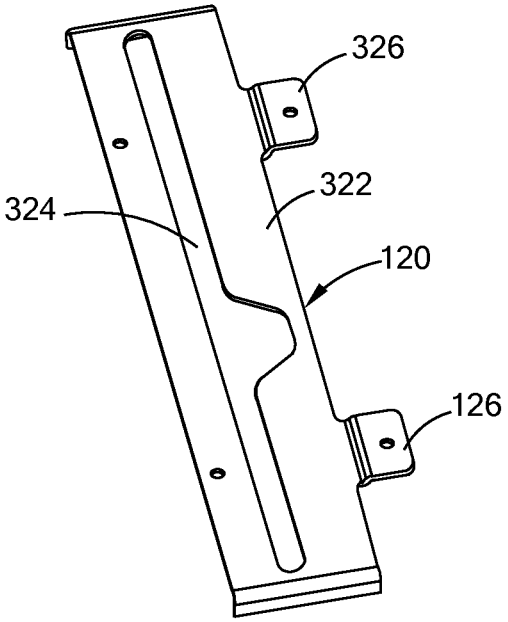
Figure 17E:
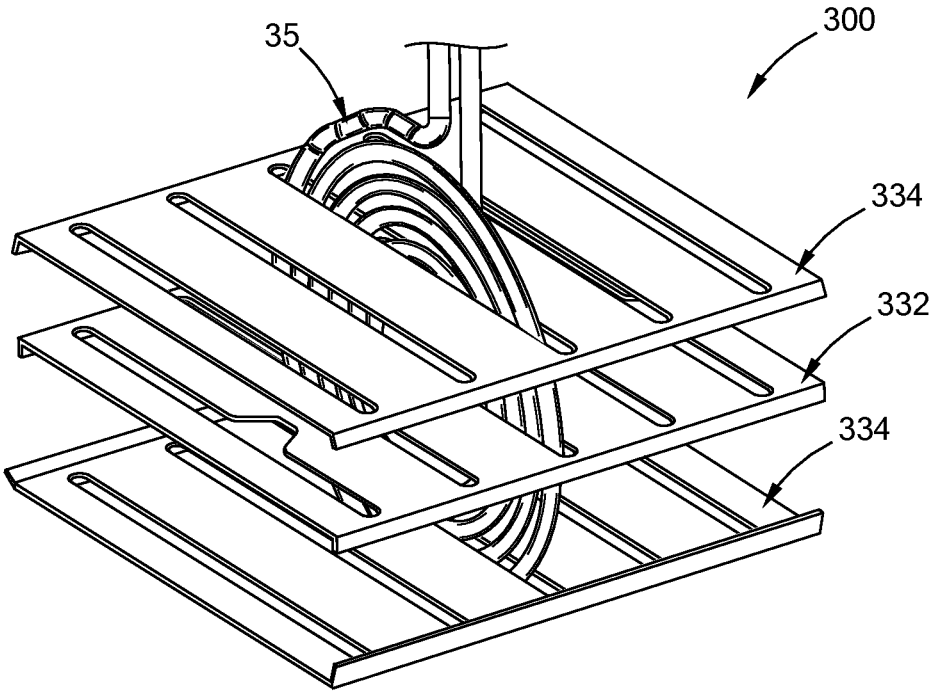
Figure 18A:
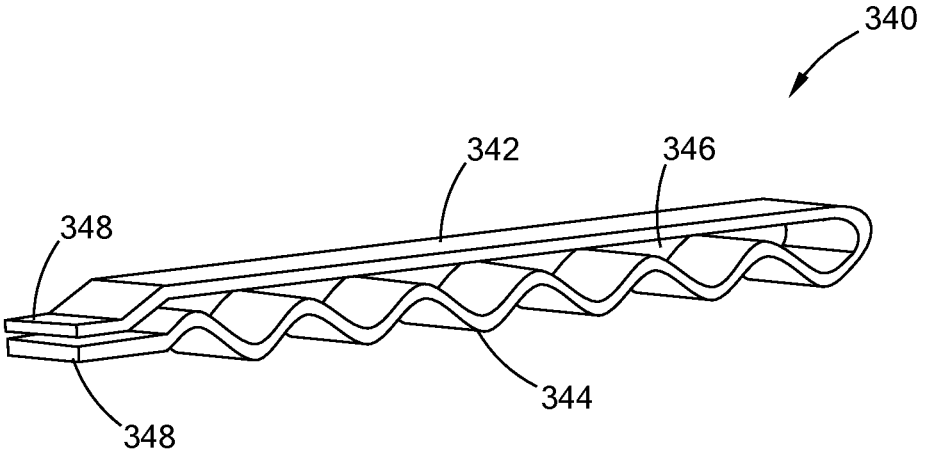
Figure 18B:
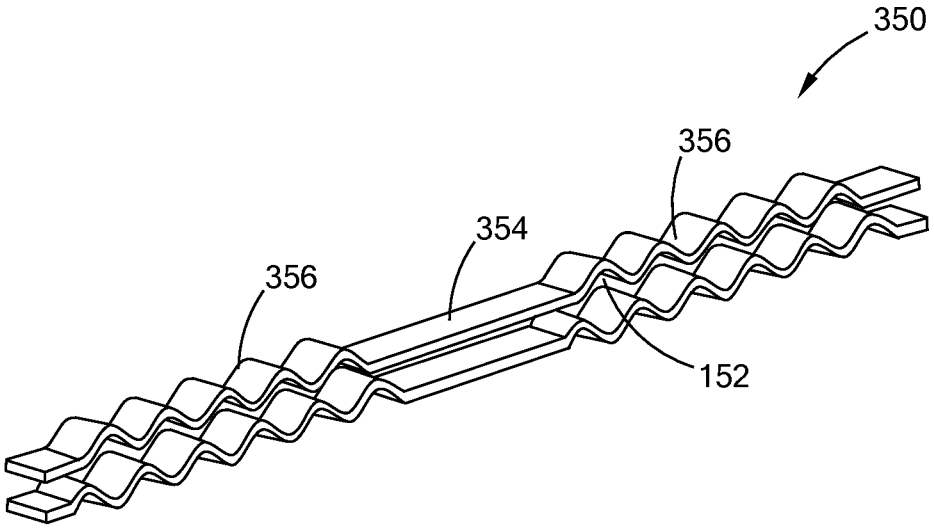
Figure 19A:
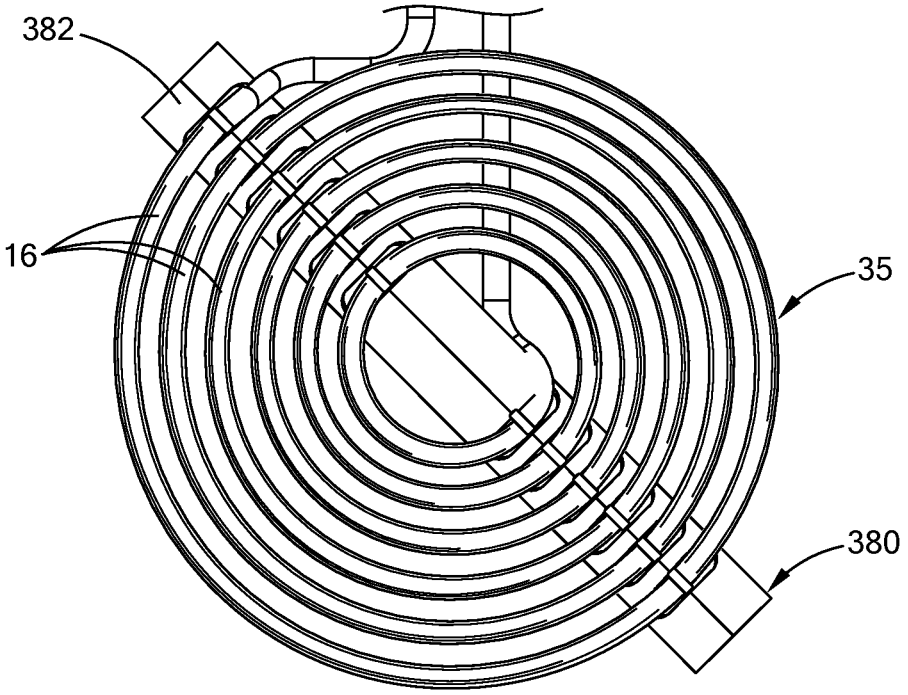
Figure 19B:
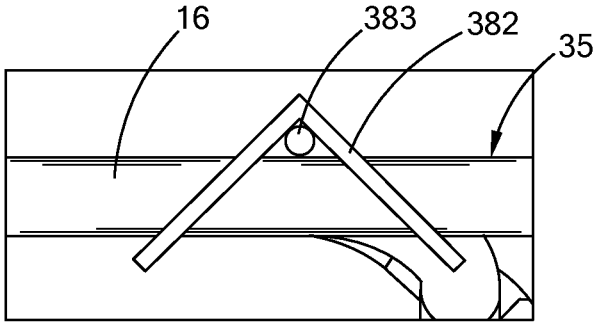
Figure 20A:
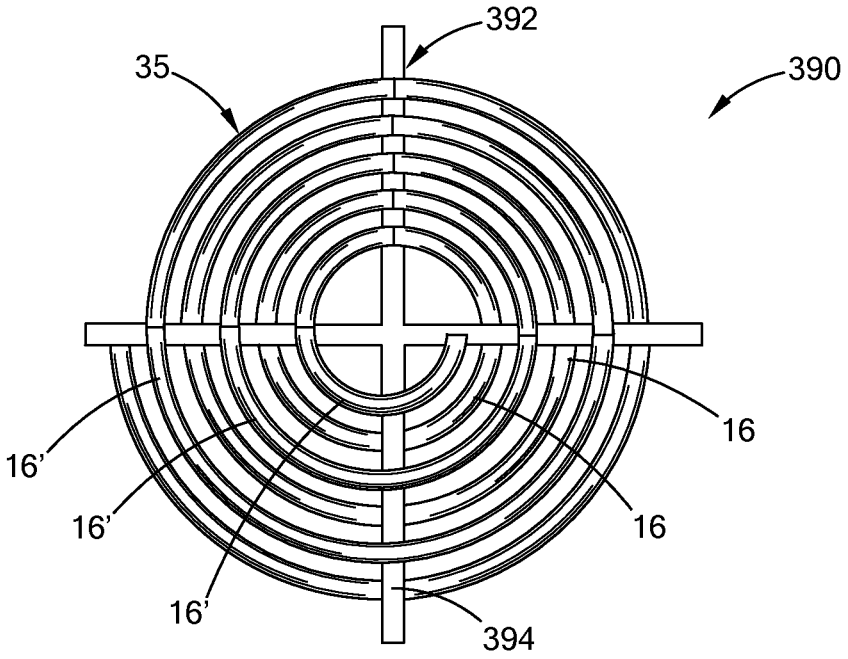
Figure 20B:
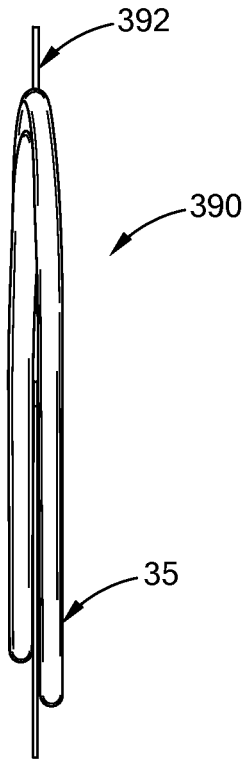
Figure 20C:
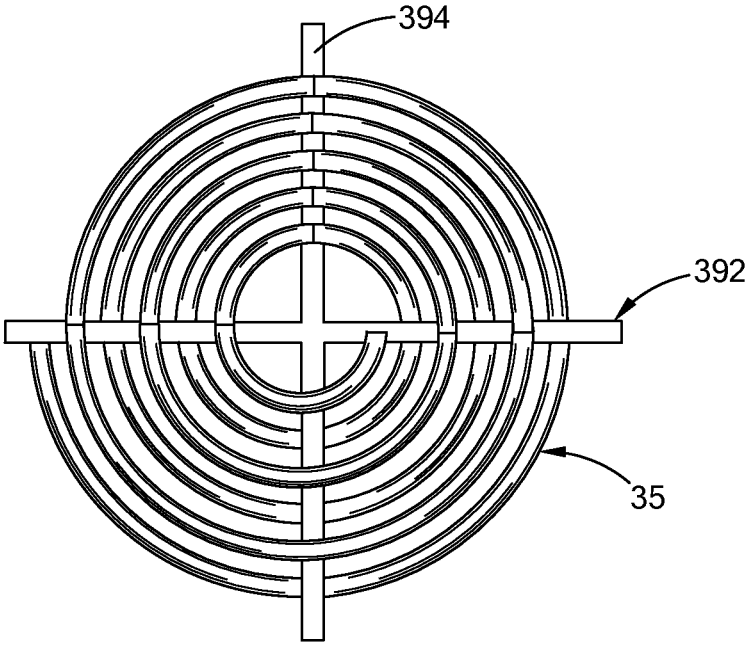
Figure 20D:
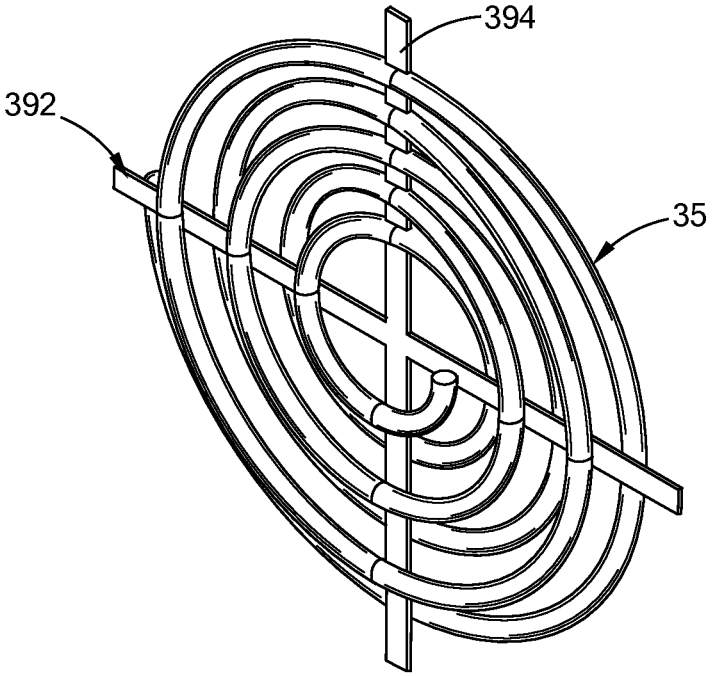
Figure 21A:
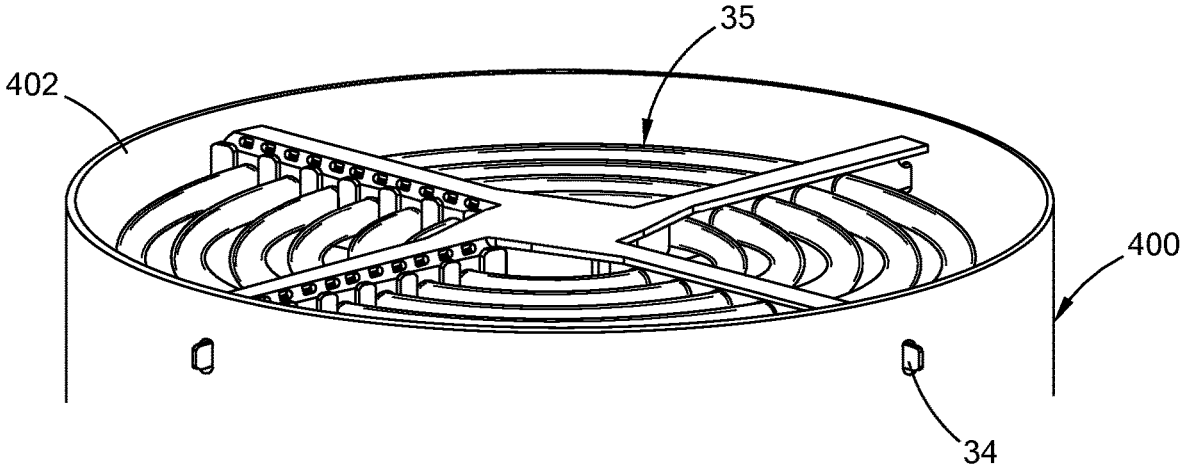
Figure 21B:
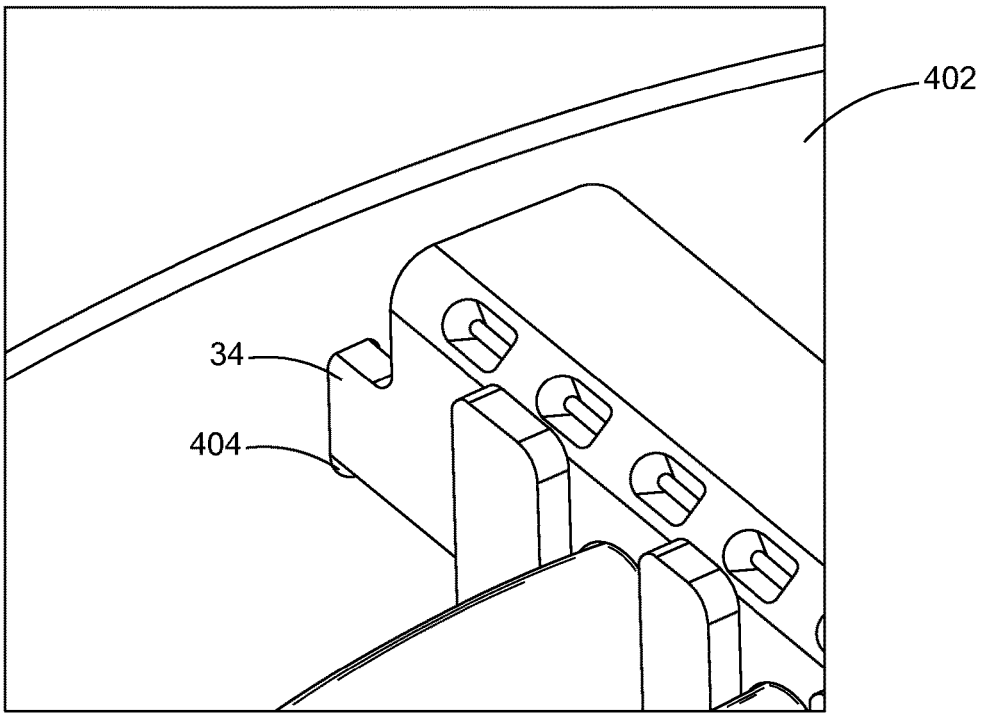
Figure 22A:
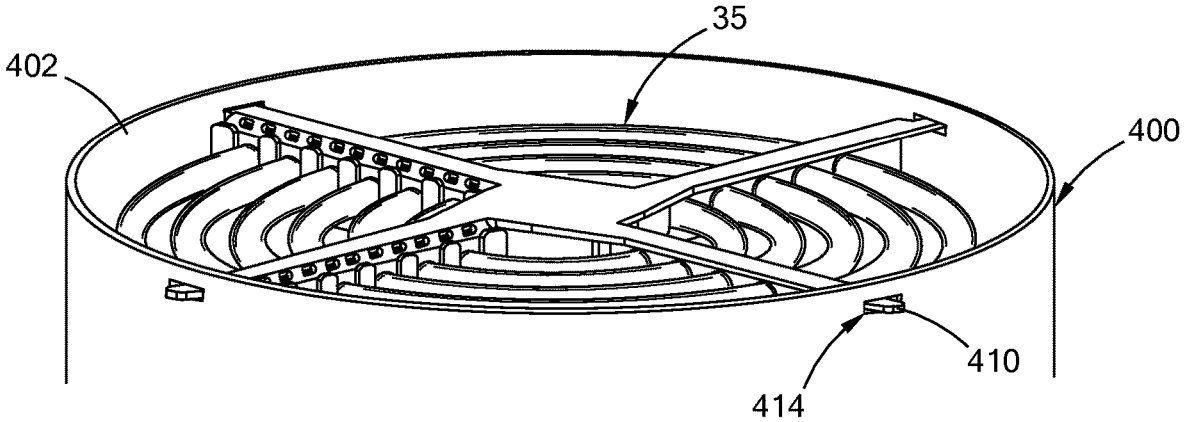
Figure 22B:
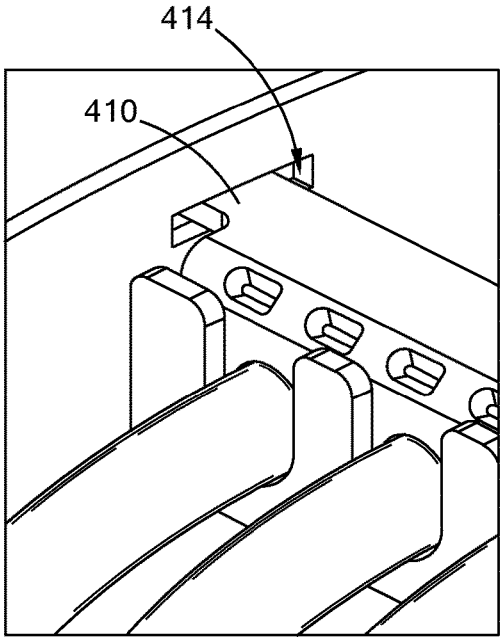
Figure 23A:
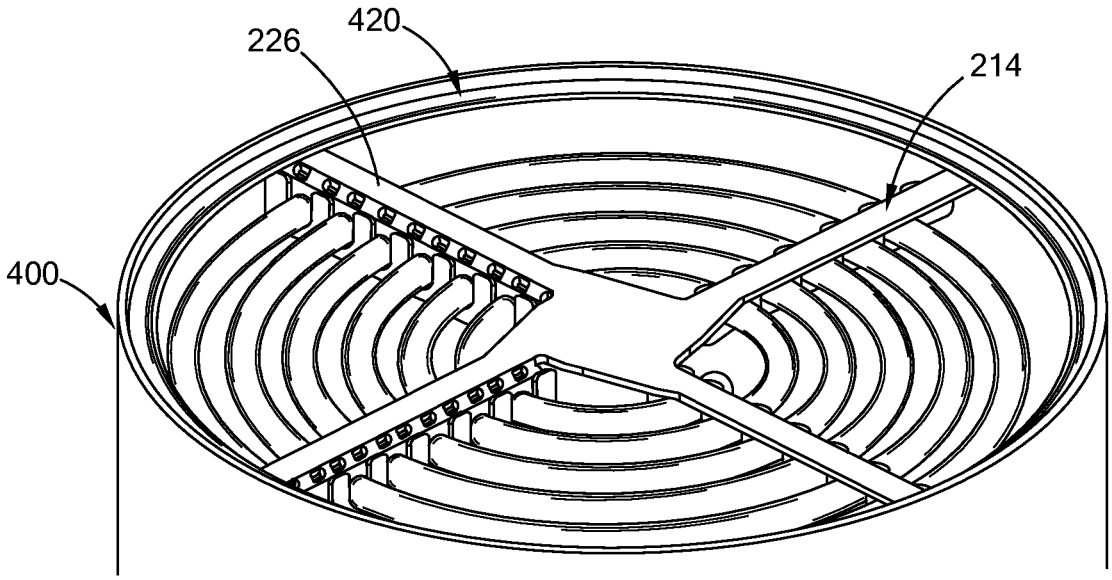
Figure 23B:
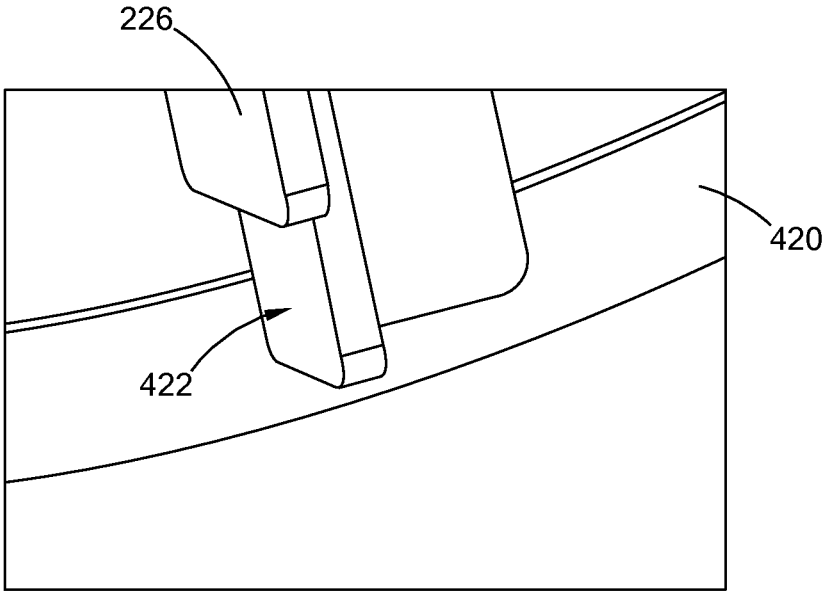
Figure 24A:
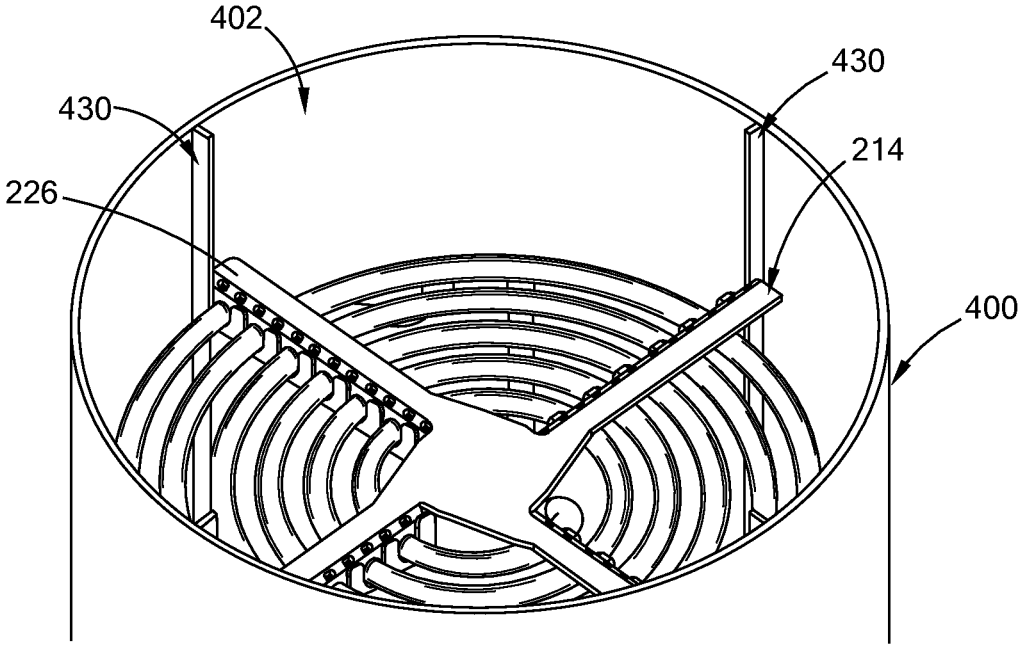
Figure 24B:
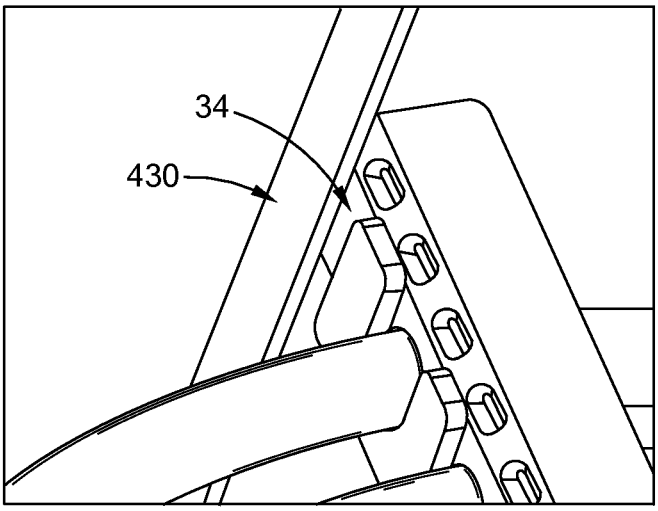
Figure 25:
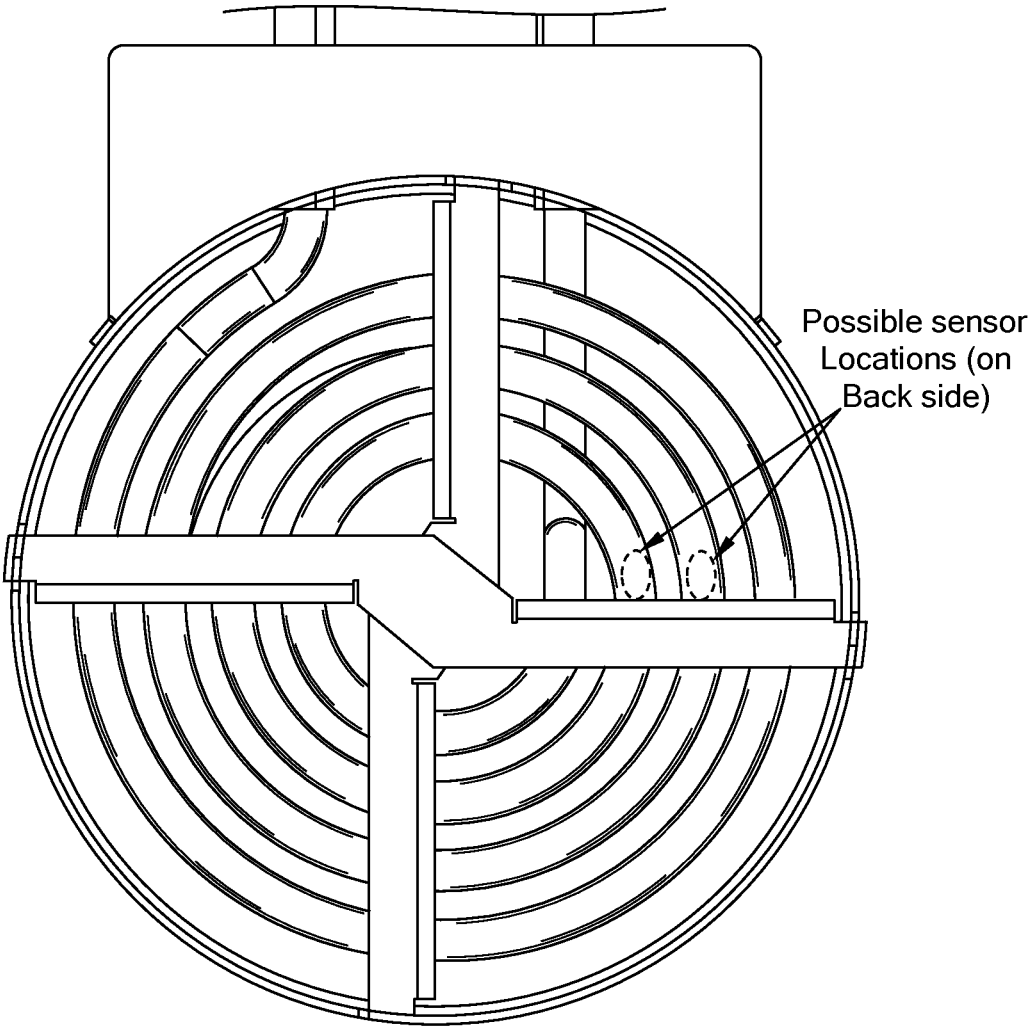
Figure 27A:
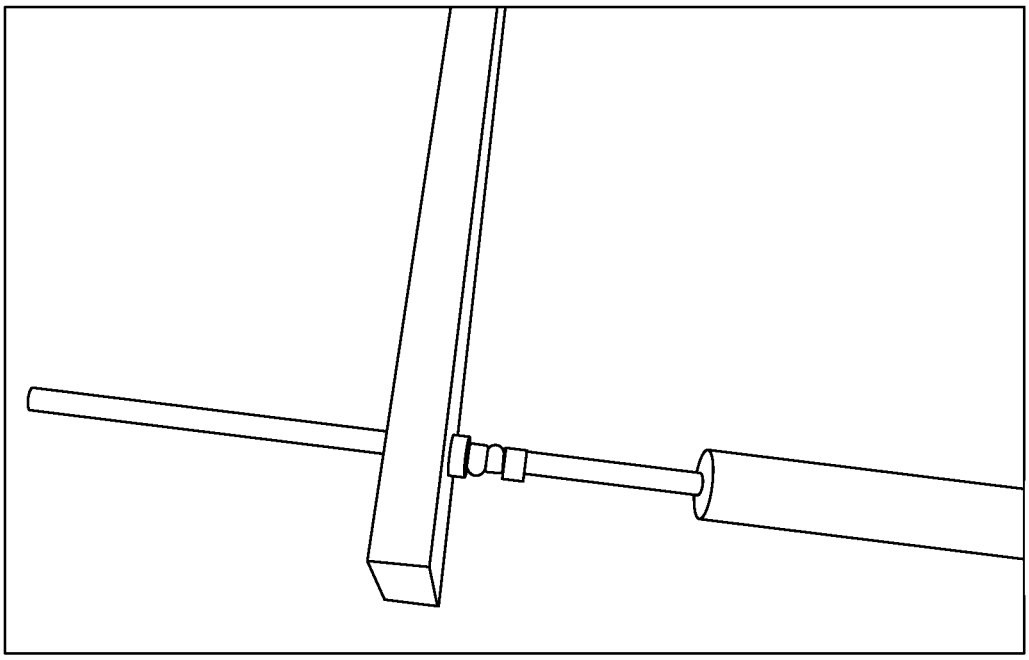
Figure 27B:
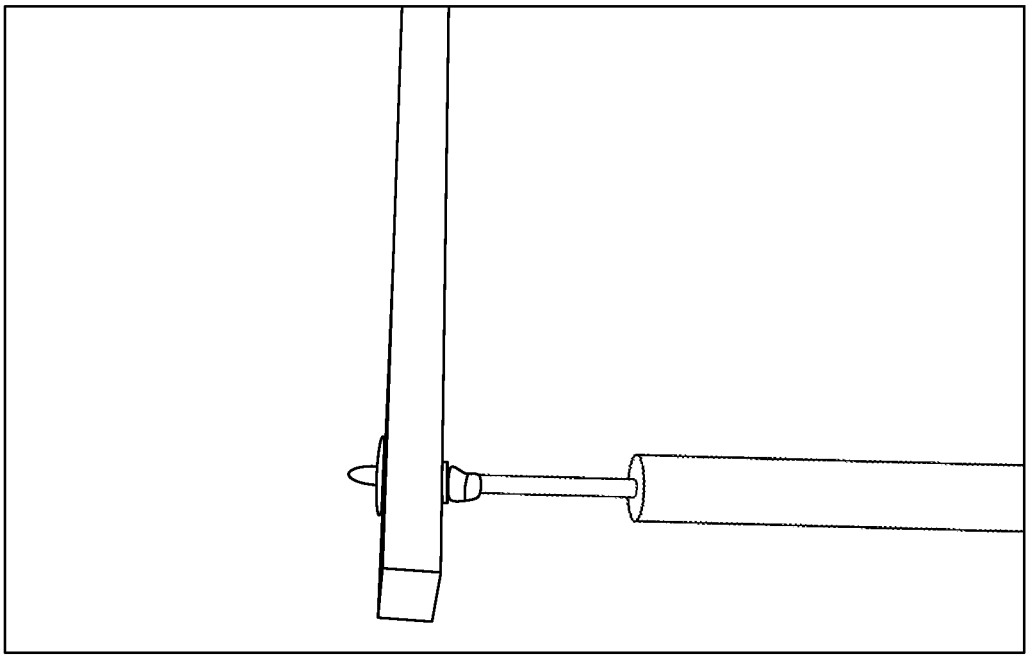
Figure 27C:
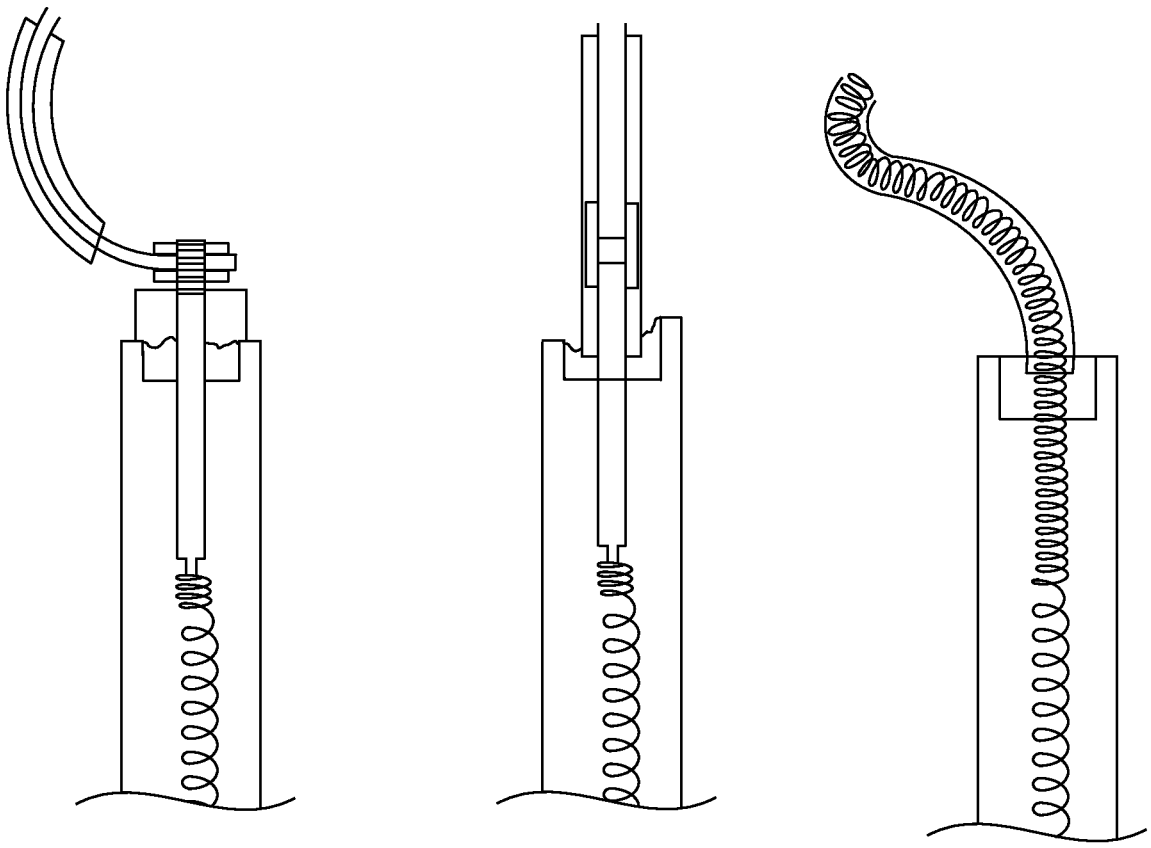
Figure 27D:
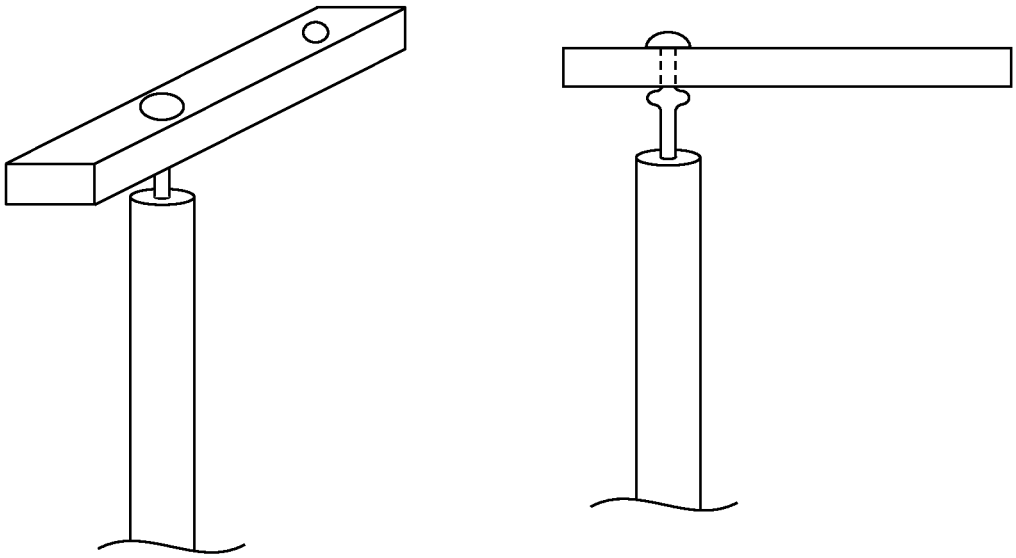
Figure 28A:
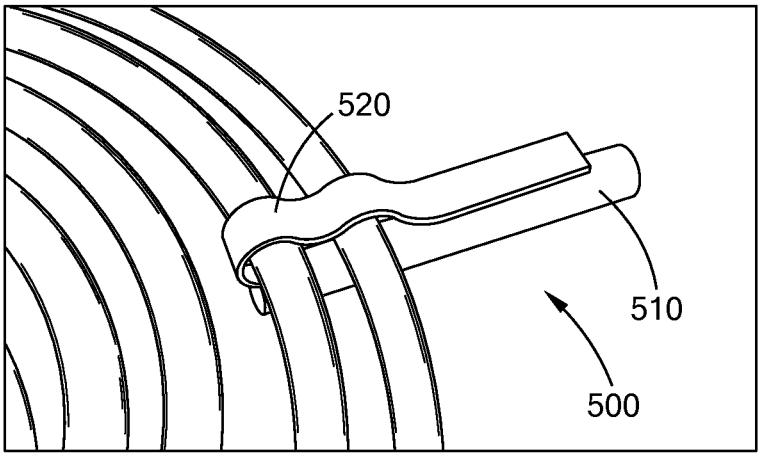
Figure 28B:
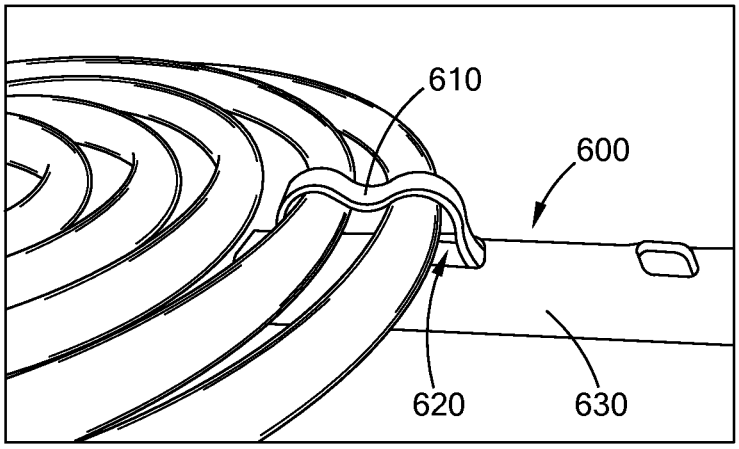

FIGS. 10A-E are perspective views of various spacer and rivet spacer shapes constructed in accordance with the present disclosure; and FIG. 11 is a schematic representation of a method of assembling the heater system according to the teachings of the present disclosure;

FIG. 12A is a perspective view of a heater assembly including a heater element and a mounting bracket according to a variant of the present disclosure;

FIG. 12B is an enlarged view of a portion of the heater assembly of FIG. 12A;

FIG. 13A is a partial perspective view of the heater assembly of FIGS. 12A and 12B;

FIG. 13B is another partial perspective view of the heater assembly of FIGS. 12A and 12B;

FIG. 14A is a perspective view of a heater assembly according to another embodiment of the present disclosure;

FIG. 14B is an enlarged view of a portion of a heater assembly of FIG. 14A;

FIG. 15 is a perspective view of a heater assembly according to another embodiment of the present disclosure;

FIG. 16A is a perspective view of a heater assembly according to a yet another variant of the present disclosure;

FIG. 16B is an enlarged view of a portion of a heater assembly of FIG. 16A;

FIG. 16C is an enlarged view of a portion of a heater assembly according to another variant of the present disclosure;

FIG. 16D is a schematic view of a portion of a heater assembly according to FIGS. 16A and 16B;

FIG. 16E is an enlarged view of a portion of a heater assembly according to still another variant of the present disclosure;

FIG. 17A is a perspective view of a heater assembly according to yet another variant of the present disclosure;

FIG. 17B is a cross-sectional view of a heater assembly of FIG. 17A;

FIG. 17C is a schematic view of a heater assembly mounted in a container body by a bracket assembly or mounting brackets and constructed according to the teachings of the present disclosure;

FIG. 17D is a perspective view of a mounting bracket according to another form of the present disclosure;

FIG. 17E is a perspective view of a heater assembly according to another form of the present disclosure;

FIG. 18A is a perspective view of a variant of a mounting bracket constructed according to the teachings of the present disclosure;

FIG. 18B is a perspective view of still another variant of a mounting bracket constructed according to the teachings of the present disclosure;

FIG. 19A is a perspective view of a heater assembly according to still another variant of the present disclosure;

FIG. 19B is a cross-sectional view of the heater assembly of FIG. 19A;

FIG. 20A is a perspective view of a heater assembly according to still another variant of the present disclosure;

FIG. 20B is a side view of a heater assembly of FIG. 20A;

FIG. 20C is a plan view of a heater assembly of FIG. 20A;

FIG. 20D is another perspective view of a heater assembly of FIG. 20A;

FIG. 21A is a perspective view of a heater assembly installed in a container body according to the present disclosure;

FIG. 21B is an enlarged view showing connection between the heater assembly and the container body of FIG. 21A;

FIG. 22A is a perspective view of a heater assembly installed in a container body according to another embodiment of the present disclosure;

FIG. 22B is an enlarged view showing connection between the heater assembly and the container of FIG. 22A;

FIG. 23A is a perspective view of a heater assembly installed in a container according to still another embodiment of the present disclosure;

FIG. 23B is an enlarged view showing connection between the heater assembly and the container body of FIG. 23A;

FIG. 24A is a perspective view of a heater assembly installed in a container body according to another embodiment of the present disclosure;

FIG. 24B is an enlarged view showing connection between the heater assembly and the container of FIG. 24A according to the teachings of the present disclosure;

FIG. 25 is a plan view of a heater assembly showing possible sensor locations according to the teachings of the present disclosure;

FIGS. 26A to FIG. 26E showing steps of installing a sheath temperature sensor according to the teachings of the present disclosure;

FIG. 27A is a plan view of a pop rivet style cold pin connected to a buss bar joint before the cold pin snaps on RAB SHB compress according to the teachings of the present disclosure;

FIG. 27B is a plan view of a pop rivet style cold pin connected to a buss bar after the cold pin snaps on RAB SHB compress according to the teachings of the present disclosure;

FIG. 27C are schematic views of a flexible cold pin termination compress according to the teachings of the present disclosure;

FIG. 27D shows schematic views of formed cold pin to buss-bar connections according to the teachings of the present disclosure;

FIG. 28A is a perspective view of an arm bracket constructed in accordance with the teachings of the present disclosure; and FIG. 28B is a perspective view of another form of an arm bracket constructed in accordance with the teachings of the present disclosure.

DETAILED DESCRIPTION

The following description is merely exemplary in nature and is not intended to limit the present disclosure, application, or uses. It should be understood that throughout the drawings, corresponding reference numerals indicate like or corresponding parts and features.

The present disclosure generally relates to a heating apparatus and a method of use associated therewith. The heating apparatus made and used according to the teachings contained herein is described throughout the present disclosure in conjunction with diesel exhaust applications in order to more fully illustrate the concept. It should be understood that the incorporation and use of this heating apparatus in conjunction with other types of thermal management applications having a thermal flow, or flow of fluid (liquid, gas, or plasma) to be heated, other than diesel exhaust applications, is contemplated to be within the scope of the present disclosure.

Figure 1:
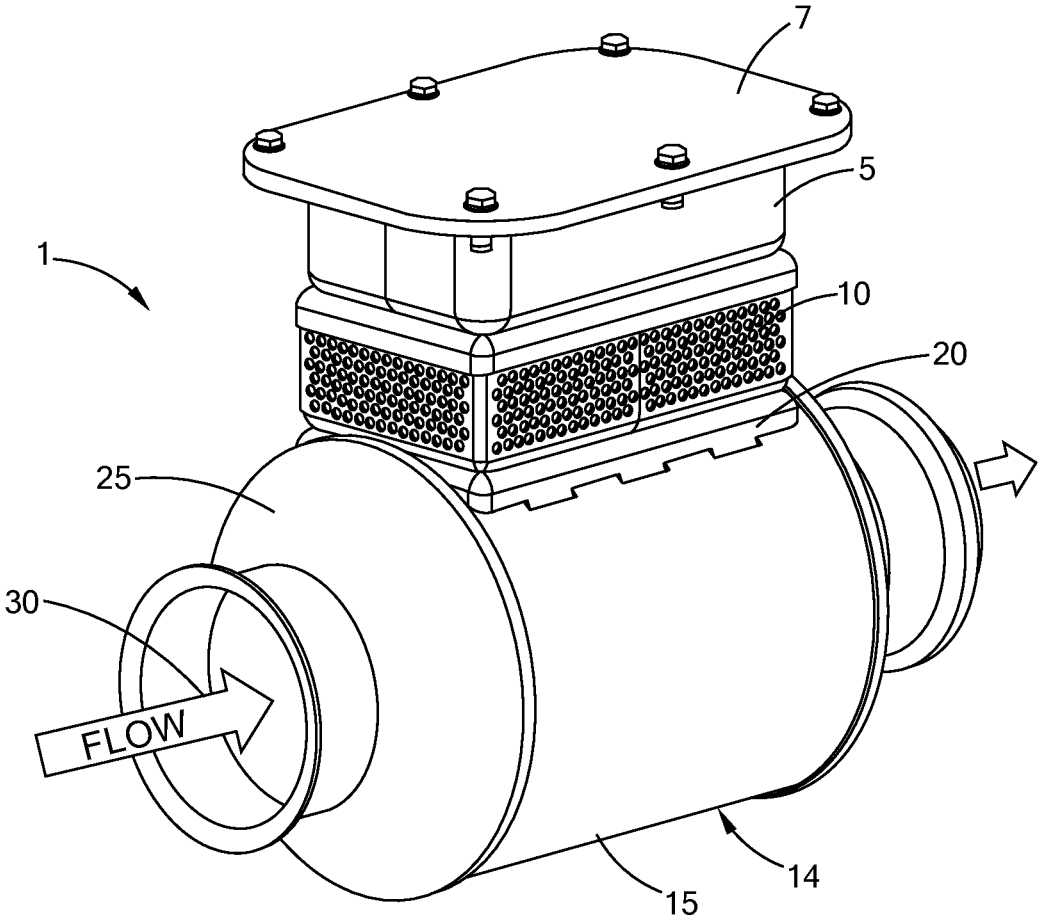
FIG. 1 is a perspective view of a heating apparatus constructed according to the teachings of the present disclosure.

Referring to FIG. 1, the heating apparatus 1 in one form generally includes a junction box 5, a perforated box assembly 10, a container body 14 including one or more separable container section components 15, and a heater flange component 20. Exhaust system coupling components 25 may be provided at opposing ends of the container body 14 to couple the heating apparatus 1 into an exhaust system (not shown). The flow of exhaust gases pass from the exhaust system into the heating apparatus 1 through a pathway 30 formed in the heating apparatus 1. The pathway 30 is defined jointly by the container body 14 and the heater flange component 20. The heater flange component 20 generally has a plate configuration in one form. The modular design of the heating apparatus 1 allows the dimensions of the various components in the heating apparatus 1 to stay the same with only the length of each component being varied to accommodate the requirement(s) of the application. A junction box lid 7 may be incorporated into the heating apparatus 1. In some applications, such as in a diesel exhaust system, among others, the vibrations arising from the application may be to such a degree that at least one support bracket (not shown) may be necessary to effectively mount the heating apparatus 1.

Figure 2A:
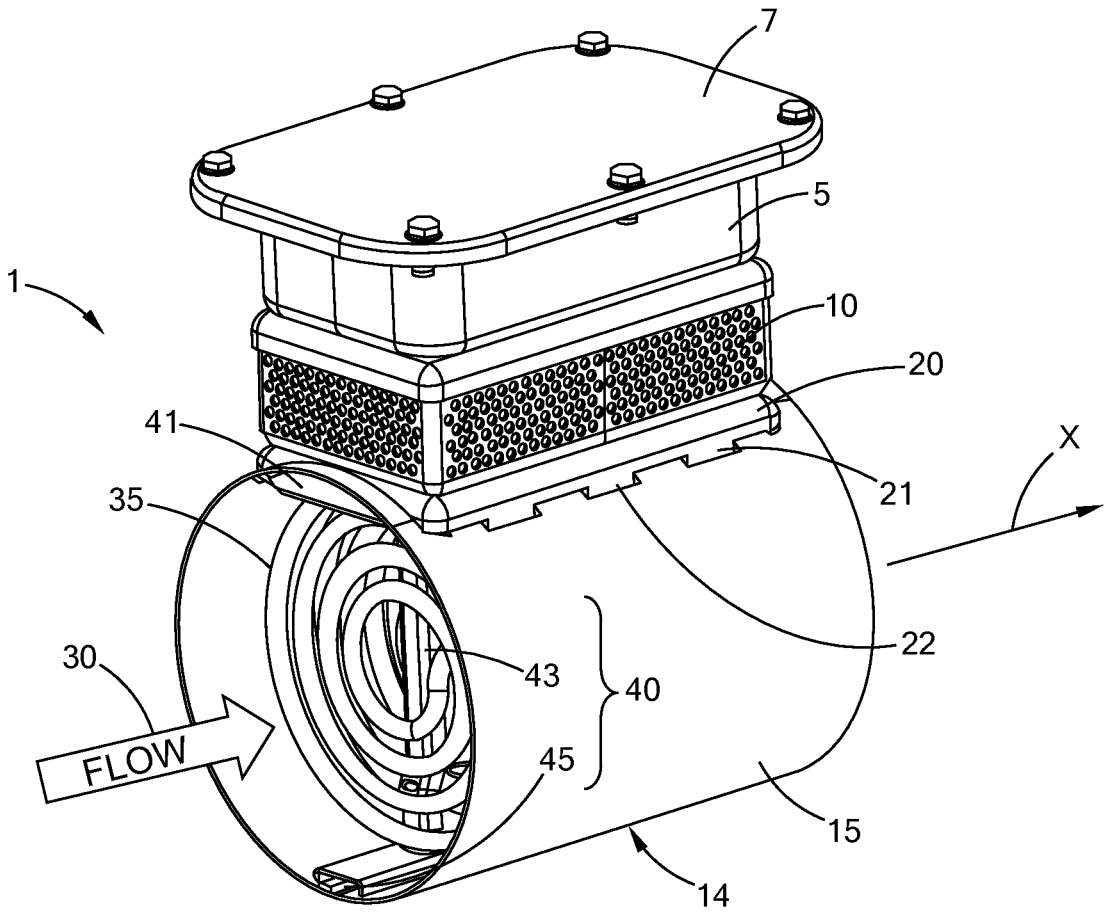
FIG. 2A is another perspective view of the heating apparatus constructed according to the teachings of the present disclosure in which the outer exhaust system coupling components have been removed.
Figure 2B:
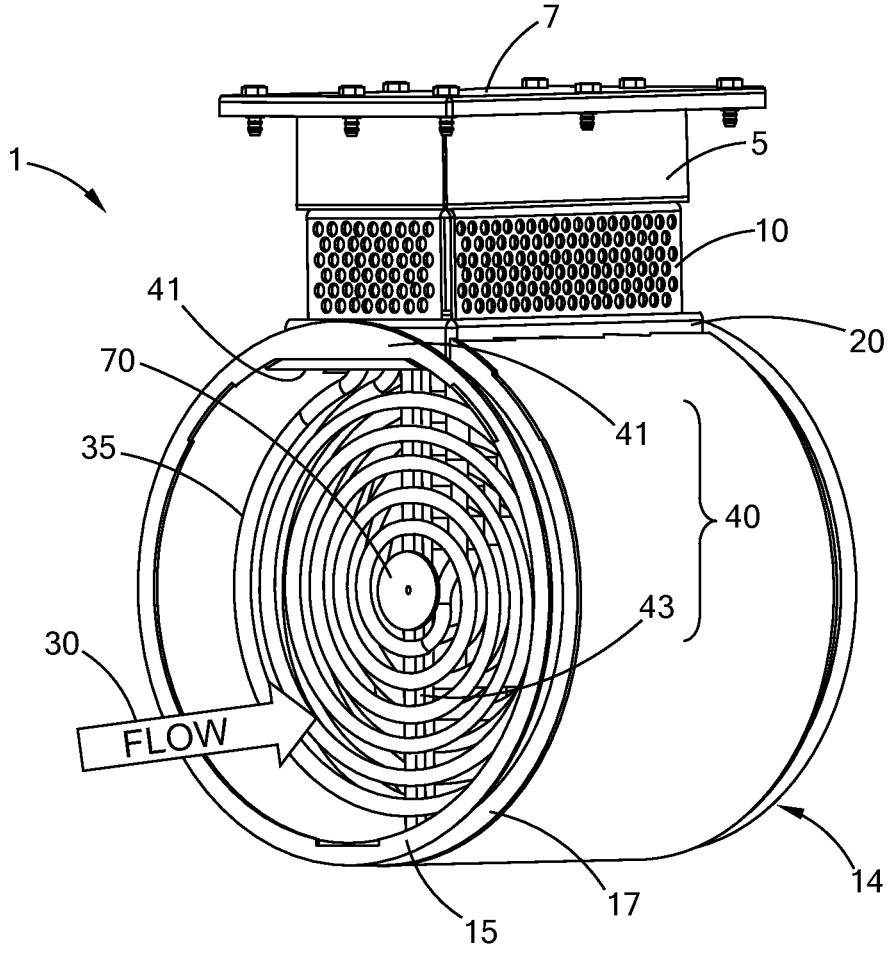
FIG. 2B is another perspective view of the heating apparatus constructed according to the teachings of the present disclosure in which the outer exhaust system coupling components have been removed.
Figure 3A:
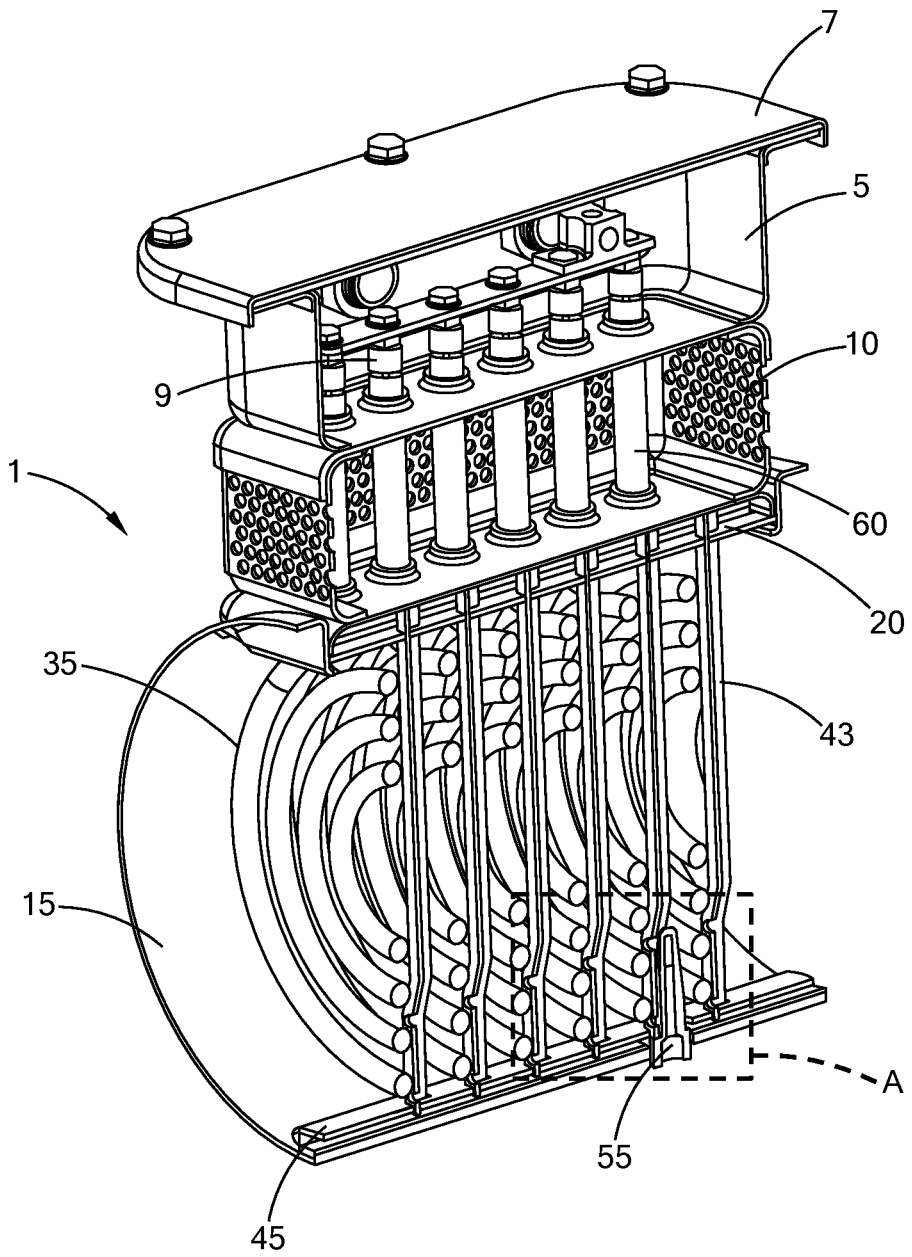
FIG. 3A is a perspective cross-sectional view of the heating apparatus of FIG. 2A.
Figure 3B:
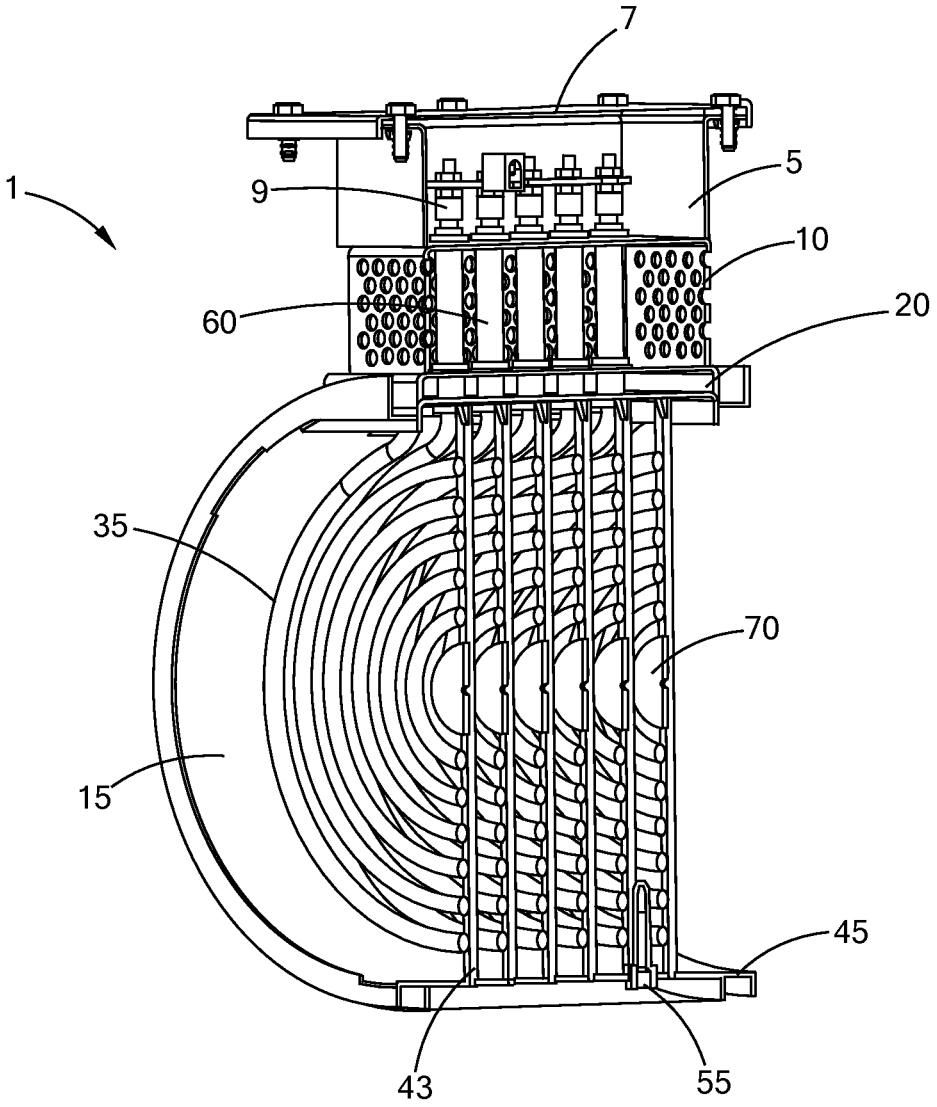
FIG. 3B is a perspective cross-sectional view of the heating apparatus of FIG. 2B.
Figure 4A:
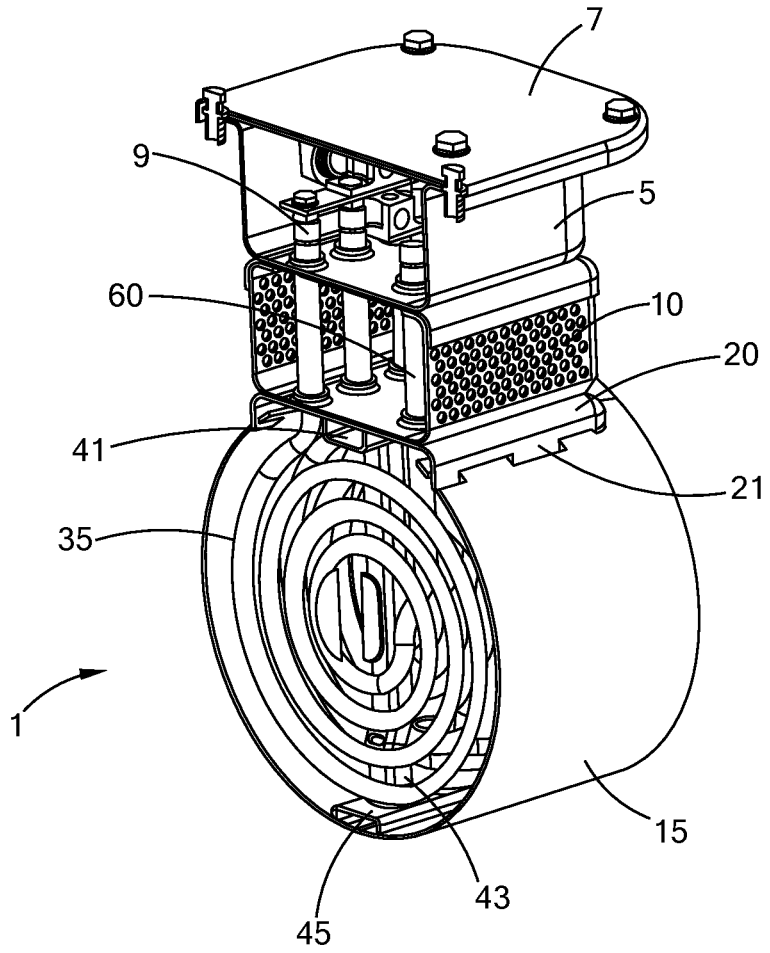
FIG. 4A is a perspective cross-sectional view of the heating apparatus of FIG. 2A.
Figure 4B:
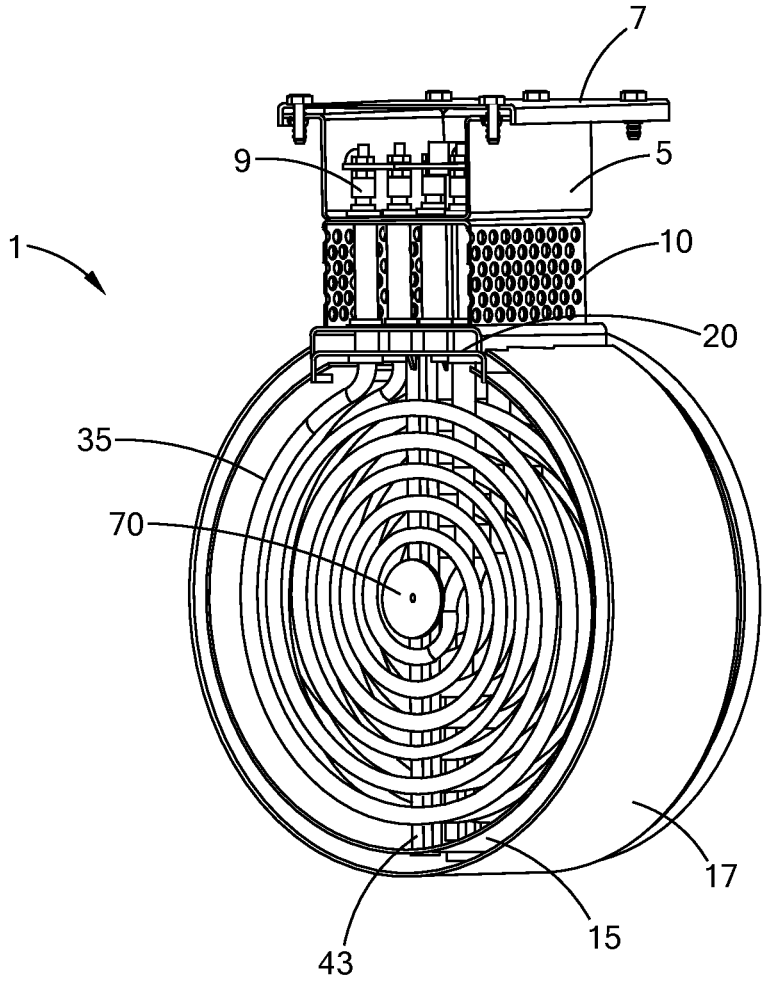
FIG. 4B is a perspective cross-sectional view of the heating apparatus of FIG. 2B.
Figure 5A:
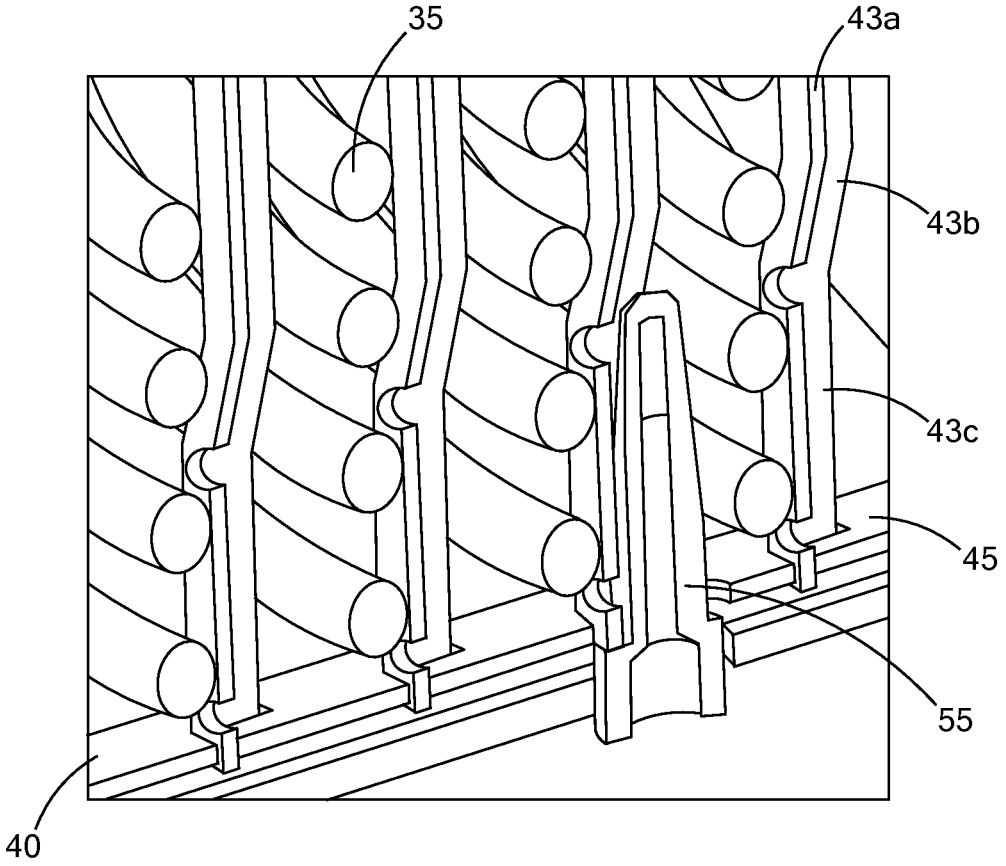
FIG. 5A is an enlarged perspective cross-sectional view of portion A of FIG. 3A.
Figure 5B:
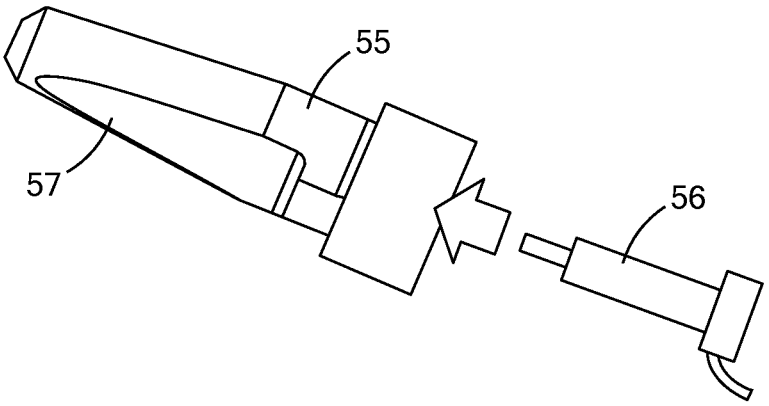
FIG. 5B is a perspective view of a thermowell and temperature sensor used in conjunction with the heating apparatus according to the principles of the present disclosure.

Referring to FIGS. 2A and 2B, the heating apparatus 1 further includes one or more heater elements 35 and a bracket assembly 40. In one form, the bracket assembly 40 includes an optional upper spine component 41, one or more element support component 43, and an optional lower spine component 45. In one form, the element support component 43 includes a plurality of posts 43 that are coupled to corresponding ones of the heater elements 35 and are arranged perpendicular to a longitudinal axis X of the container body 14. The posts 43 are coupled to either the container section components 15 of the container body 14 or to the optional upper spine component 41 and lower spine component 45. The posts 43 may be directly coupled to the heater flange component 20 when desirable for applications that do not require the bracket assembly 40 to have an upper spine component. The posts 43 include an optional flow diverter 70 that blocks the flow of exhaust gas down the center of the pathway 30 formed in the heating apparatus 1.

The heater element 35 may exhibit predetermined (e.g., measured) or predictable performance characteristics. One example of such performance characteristics includes the rate of heating for the heater element 35 when it is exposed to a preselected voltage or under a specified process flow condition. The heater element 35 is selected as a cable heater, a tubular heater, a cartridge heater, a flexible heater, a layered heater, a metal foil, or a metal fleece heater. Alternatively, the heater element 35 is a cable heater or tubular heater.

The heater flange component 20 is coupled with the one or more container section components 15 of the container body 14, such that they form an external shroud that surrounds the one or more heater elements 35 and establishes the pathway 30 for the flow of exhaust gas through the heating apparatus 1. The heater flange component 20 and the one or more container section components 15 may contact one another through the use of tabs 21. The tabs 21 may be located on either the heater flange component 20 or the one or more container section components 15. Each tab 21 in one component 15, 20 is mated to a hole 22 located in the other component 20, 15. The use of the tabs 21 facilitates the assembling of the heater flange component 20, the bracket assembly 40, and the heater elements 35 prior to coupling the heater flange component 20 to the container body 14.

Referring now to FIGS. 3A, 3B, 4A, and 4B, the junction box 5 establishes an electrical connection 9 between the heater elements 35 and a power source (not shown), while the perforated box assembly 10 provides a means to cool the electrical connections 9 and heater elements 35 by creating a longer path for conduction and radiation heat transfer, as well as allow for convective air cooling. The perforated box assembly 10 has at least one wall or skirt that is perforated, thereby, exposing the interior of the perforated box assembly 10 to the atmosphere. The perforated box assembly 10 is used in applications in which the magnitude of heat is such that cooling of the junction box 5 is required. One skilled in the art will understand that the perforations present in the wall or skirt may represent one or more perforations with each perforation being of any size or shape.

The heating apparatus 1 may further include one or more standoff tubes 60 that project from the perforated box assembly 10 through the heater flange component 20 into the external shroud formed by the container section components 15. Each standoff tube 60 encompasses a heater element 35 to provide mechanical support for the heater element 35. One or more of the top and bottom of the optional perforated box, the walls of the perforated box and the standoff tubes may be brazed together using nickel or copper. When desirable, one skilled in the art will understand that it is possible to braze the heater elements 35 directly to the junction box 5 and the optional perforated box 10, thereby, not requiring a standoff tube 60. The brazing can be done by any means known to one skilled in the art, including but not limited to furnace brazing at one time or through a manual brazing process.

The heater flange component 20, the perforated wall or skirt of the perforated box assembly 10, and the standoff tubes 60 may be made from any material suitable for use in an exhaust system; alternatively, they are made from a metal or metal alloy. A metal joining process, such as brazing, among others, may be used to join the heater flange component, perforated skirt of the perforated box assembly, and the standoff tubes. One specific example of a metal joining process includes first tack-welding the components to be joined into position and then performing nickel brazing in a furnace. Such a brazing process provides strength and seals the exhaust, while making all of the joints to the standoff tubes at one time.

The heating apparatus 1 may be a "smart" heating apparatus and may include a combination of at least one heater element 35 and at least one temperature sensor 56. Optionally, the heating apparatus 1 may further include a LIN bus, a CAN bus, or other type of bus capable of providing a communication pathway between at least two system components.

The temperature sensor 56 may be in contact with the sheath of the heater element 35, located on an element support component (e.g., the post 43) adjacent to the heater element 35, or located upstream or downstream of the heater element 35. The sensor 56 can measure the temperature in a specific or desired location of the heater element 35. The measurement of temperature by the sensor 56 allows the heating apparatus 1 to reduce power when the heater element 35 is approaching or surpassing a predetermined temperature limit established according to the application being performed. The temperature sensor 56 may also be used for diagnostic purposes. Alternatively, the heating apparatus 1 includes multiple heater elements 35 and temperature sensors 56, the temperature sensors 56 being a combination of individual sensors or a multiple junction sensor capable of providing more than one temperature measurement.

A smart heating apparatus provides the benefits of enhanced diagnostic capability in addition to maximizing heat flux and lowering manufacturing cost. A robust diagnostic capability often depends on the variation exhibited from heater element to heater element. A smart heating apparatus that is capable of using performance characteristics or information for specific heater elements provides for enhanced diagnostic capability by allowing at least a portion of the random variation that arises from manufacturing variances to be corrected or compensated for. The smart heating apparatus may compensate for a thermal gradient present in a diesel oxidation catalyst (DOC), diesel particle filter (DPF), selective catalytic reducer, lean NOx traps, or another exhaust component that includes an after-treatment catalyst. One skilled in the art will understand that other diagnostic activities may also be enabled through the use of smart heating apparatus.

Referring now to FIGS. 3A, 3B, 5A, and 5B, the heating apparatus 1 may further comprise a thermowell 55 integrally attached to the post 43 of the bracket assembly 40, such that the thermowell 55 allows indirect and/or direct contact between the heater element 35 and the temperature sensor 56. A thermowell 55 is a tubular fitting used to protect a temperature sensor 56 when installed for use in the heating apparatus 1. The thermowell 55 may also be tubular fitting that is open on both ends, thereby, allowing the temperature sensor 56 to make direct contact with the flowing exhaust gases, while acting as a seal to prevent the escape of the gases when the temperature sensor 56 is inserted into the heating apparatus 1. The thermowell 55 may be placed in contact with any of the posts 43 of the bracket assembly 40. Alternatively, the thermowell 55 may be placed on the second to last heater element 35 in the heating apparatus 1 because it is typically one of the hottest coils and the exhaust gas flows past it immediately prior to exiting the heating apparatus 1. The temperature sensor 56 may be selected as a thermocouple, a thermistor, or a resistance temperature device. When desirable, the temperature sensor 56 does not have to actually contact the heater element 35. In the illustrated design, the heater element 35 actually contacts the post 43 and/or U channel bracket 80 (shown in FIGS. 6A and 7B), while the thermowell 55 contacts the post 43 and the temperature sensor 56 contacts the thermowell 55. One skilled in the art will understand that it is desirable to have a consistent thermal pathway for the life of the product, but not necessarily for the elements to be in direct contact.

Figure 6A:
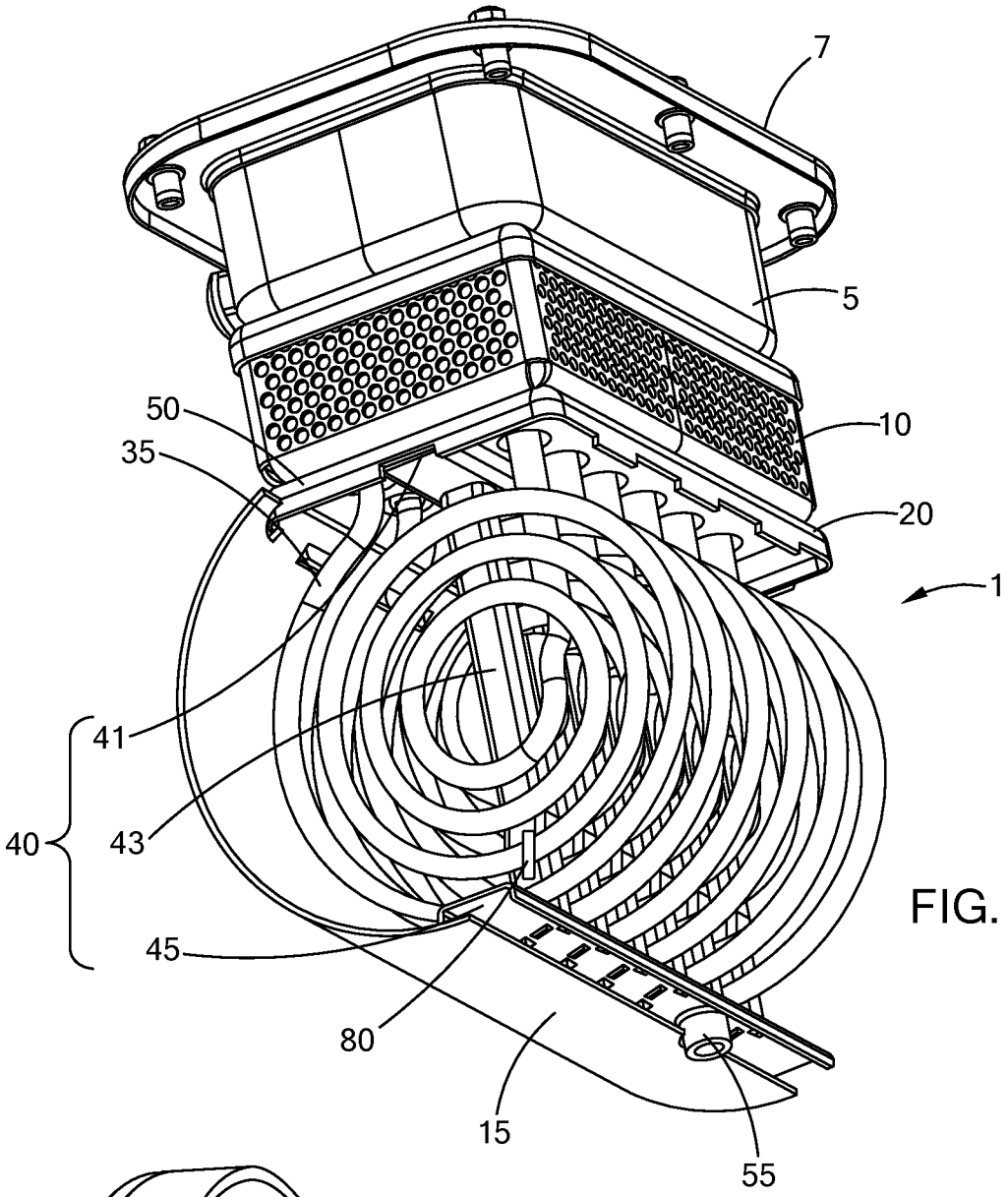
FIG. 6A is another perspective view of the heating apparatus of FIG. 2A further illustrating the internal components of the heating apparatus constructed in accordance with the present disclosure.

Referring to FIG. 6A, the bracket assembly 40 includes an optional upper spine component 41, one or more element support component/mounting bracket in the form of posts 43, at least one conformal bracket 80, and an optional lower spine component 45. The bracket 80 is "conformal" as it is shaped to conform to the shape of the heater element 35 as shown. In operation, with larger sizes of heater elements 35, it is desirable to support the heater elements 35 for vibration resistance. With a heater element 35 having a circular cross-section, the conformal bracket 80 is correspondingly shaped with internal radii as shown to conform to the shape of the heater element 35.

The posts 43 are arranged perpendicular to the longitudinal axis X and parallel to one another. When the upper and lower spine components 41 and 45 are provided, the upper and lower spine components 41 and 43 make contact with the heater flange component 20. When desirable, the lower spine component 45 may make contact with the thermowell 55. The one or more posts 43 contact either the container section component 15 or the optional upper spine component 41 and lower spine component 45. When the upper and lower spine components 41 and 45 are not provided, the posts 43 may be directly coupled to the heater flange component 20. The upper and lower spine components 41 and 45 extend along a longitudinal direction X of the container body 14 and run parallel with the pathway 30 for the flow of exhaust gases through the heating apparatus 1 established between the heater flange component 20 and the one or more container section components 15.

Figure 6B:
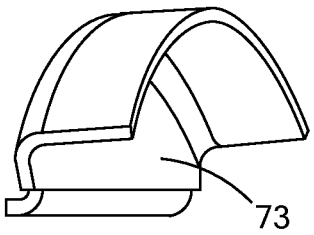
FIG. 6B is a perspective view of a patch seal used in the heating apparatus constructed in accordance with the present disclosure.

In FIG. 6B, a patch seal 73 is used to seal the heater flange component 20 to the container section components 15. One or more patch seals 73 may be used in the heating apparatus 1.

Figure 7C:
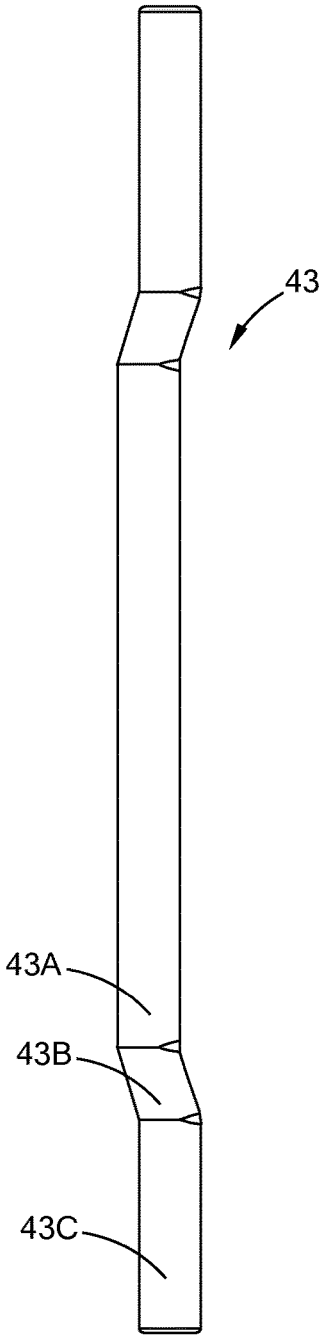
FIG. 7C is a side view of the post of the bracket assembly constructed in accordance with the present disclosure.

Referring again to FIG. 5A, as well as FIG. 7(A-C), the post 43 of the bracket assembly 40 is bent approximate to the location where the heater element 35 or the temperature sensor 56 and hence the thermowell 55 is coupled to the post 43. Optionally, the post 43 may be bent in multiple locations as shown in FIG. 7C when necessary in order to accommodate larger heater elements 35 in the heating apparatus 1. As shown in FIG. 7C, the post 43 is bent such that the post 43 includes a raised section 43C, a recessed section 43A, and a connecting section 43B therebetween. When the heater element 35 is coupled to the post 43, the heater element 35 only contacts the raised section 43 and does not contact the recessed section 43A and the connecting section 43B. Therefore, the possible frictional wear between the heater element 35 and the post 43 due to the rubbing or movement of the heater element 35 on the post 43 may be reduced.

Figure 7A:
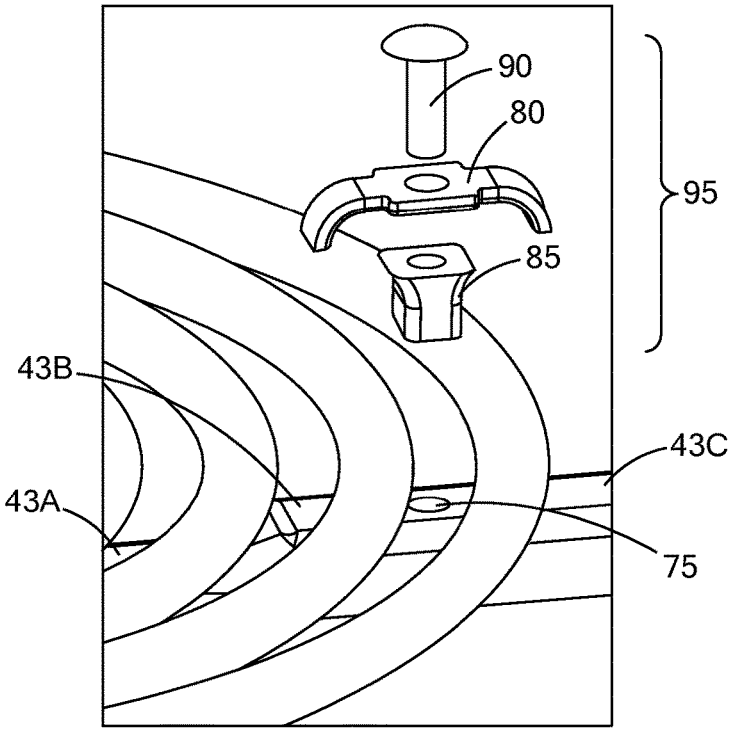
FIGS. 7A and 7B are partial perspective views showing a coupling for coupling the heater element to a post of a bracket assembly and constructed in accordance with the present disclosure.
Figure 7B:
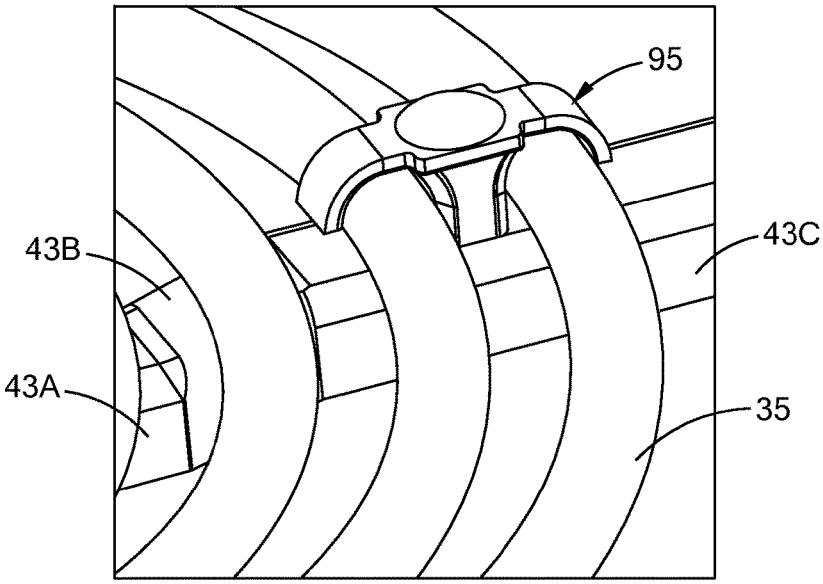

As shown in FIG. 6A, and also FIGS. 7A and 7B, the conformal bracket 80 in one form is a U-channel and is used to couple one or more heater elements 35 to the post 43, particularly the raised section 43C.

Referring now to FIGS. 7A and 7B, the conformal bracket 80 in one form is a rivet assembly 95. The rivet assembly 95 includes a rivet 90 and optionally a rivet spacer 85 used to hold the conformal bracket 80 to the raised section 43C of the post 43. The rivet 90 is mated with a hole 75 defined in raised section 43C of the post 43. It should be understood that other forms of fasteners/fastening, such as by way of example welding, quick disconnects, or bolts, rather than the rivet 90 may be employed while remaining within the scope of the present disclosure. Additionally, the conformal bracket may take other geometric forms, such as a "C" or other polygonal form that mates with the corresponding heater element 35 shape, rather than the "U" shape while remaining within the scope of the present disclosure.

Figure 8A:
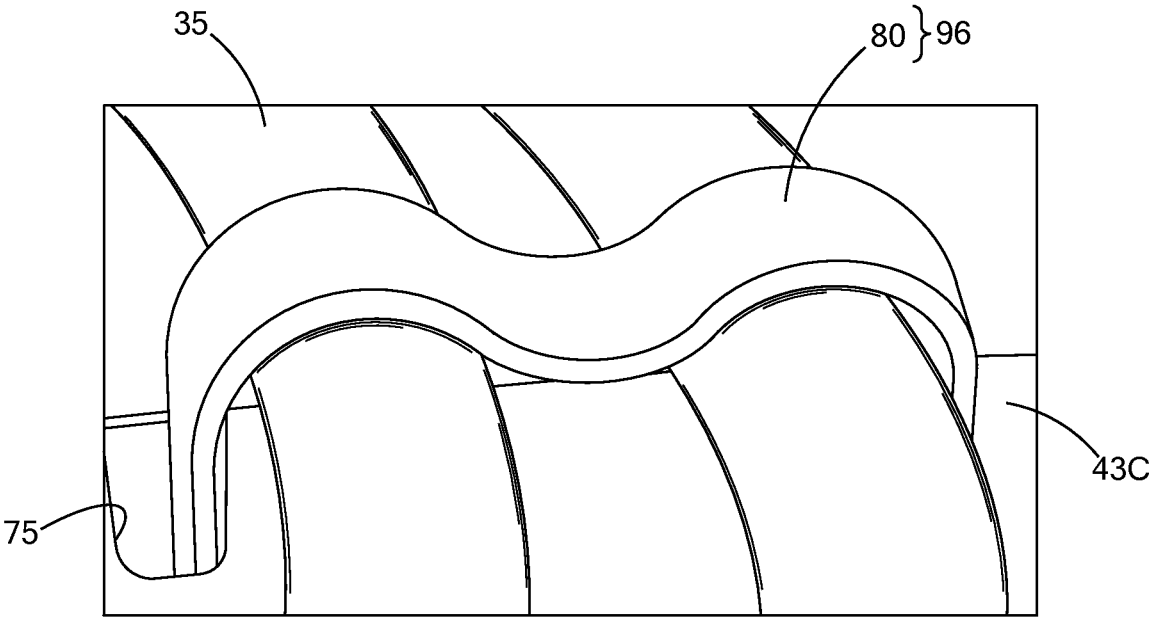
FIGS. 8A and 8B are perspective views showing another coupler for coupling the heater element to a post of the bracket assembly and constructed in accordance with the present disclosure.
Figure 8B:
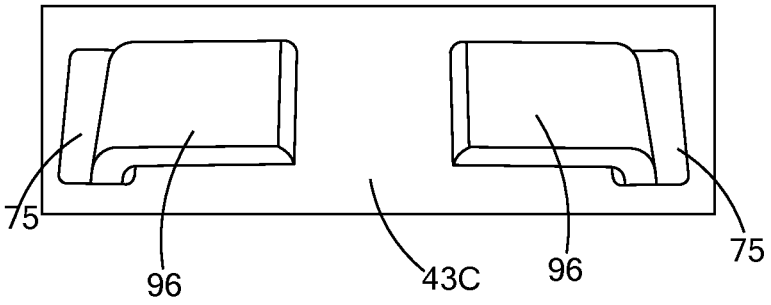

Referring to FIGS. 8A and 8B, the U-channel conformal bracket 80 in the form of a staple 96 is mated with two holes 75 in the post 43, particularly the raised section 43C. In order to securely couple the heater element 35, the joining process may optionally include welding or brazing the U-channel conformal bracket 80 to the post 43. As shown in FIGS. 7A, 7B, and 7C, the heater elements 35 may be coupled directly to the post 43.

Figure 8C:
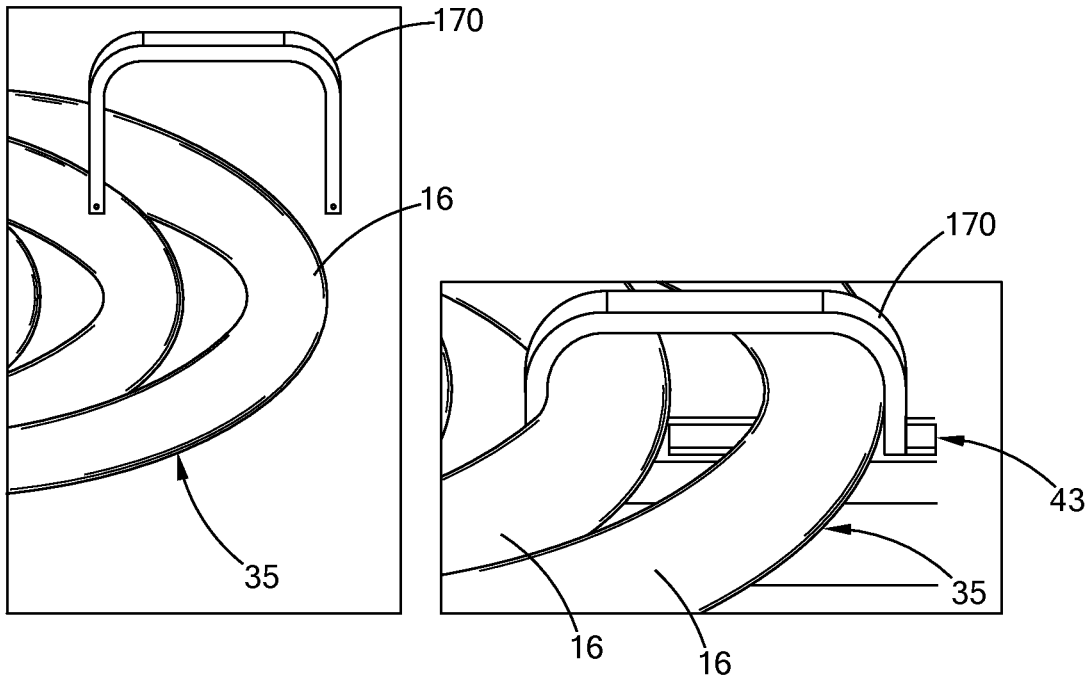
FIG. 8C is a perspective view of still another coupler for coupling the heater element to a post of the bracket assembly and constructed according to the teachings of the present disclosure.
Figure 8D:
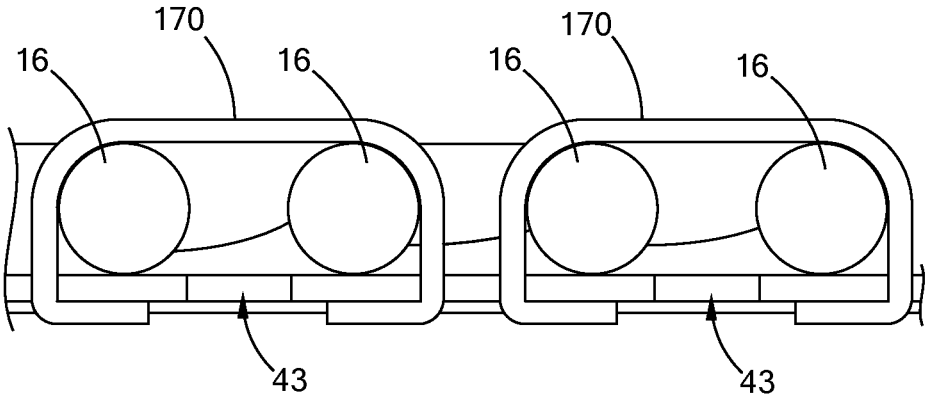
FIG. 8D is a cross-sectional view of the coupler of FIG. 8C.

Referring to FIGS. 8C and 8D, a variant of a conformal bracket 170 for securing the heater element 35 to the post 43 is in the form of a staple member 170 that has a sufficient length to cover two or more coiled portions 16 of the heater element 35. Similarly, the staple member 170 has two arms inserting into corresponding holes in the post 43. After insertion, the two arms are bent against the post 43 to secure the heater element 35 to the post 43.

Figure 9:
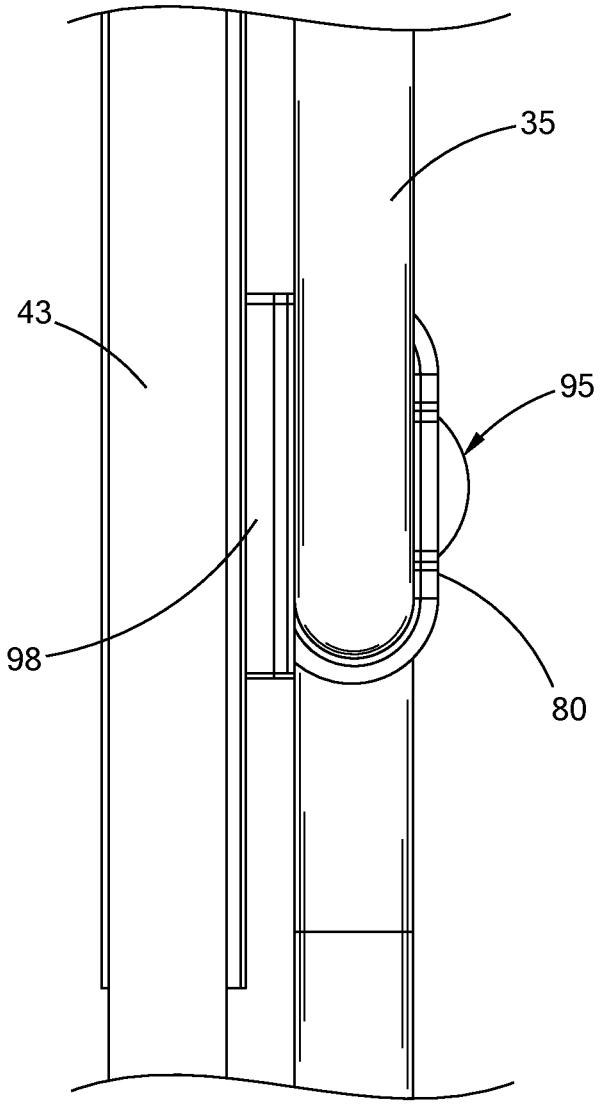
FIG. 9 is a side view showing the use of a spacer between the heater element and the post of the bracket assembly and constructed in accordance with the present disclosure.

Referring to FIG. 9, the bracket assembly 40, which includes one or more posts 43, may optionally utilize spacers 98 located between the posts 43 and the heater elements 35. The spacers 98 create separation between the heater element 35 and the posts 43 at locations other than where they are coupled together in order to reduce wear. The spacers 98 accomplish a similar effect as bending the posts 43 as previously described above. The spacers 98 may be used in addition to the bending of the posts 43. The shape of the spacer 98 may vary depending upon the shape of the heater element 35 and the post 43. Several examples of spacers 98 are shown in FIGS. 10A and 10B to include indented corners 98A and/or beveled edges 98B. One skilled in the art will understand that other spacer shapes may be utilized without exceeding the scope of the present disclosure.

Similarly, the shape of the rivet spacer 85 may also vary depending upon the desired performance. Several examples of rivet spacers 85 are shown in FIGS. 10(C-E) to include a tapered design 85A, a square design 85B, and a round design 85C. One skilled in the art will understand that other rivet spacer shapes may be utilized without exceeding the scope of the present disclosure.

Referring to FIG. 11, a method 100 for assembling the heater system 1 includes: providing all of the components in step 105; assembling the bracket assembly 40 and the one or more heater elements 35 in step 110; coupling the heater flange component 20 and the one or more container section components 15, 17 together to form the external shroud/container body 14 in step 120; and assembling the junction box 5 and optionally, the perforated box 10 to the heater flange component 20 in step 115.

More specifically, the components that are provided in step 105 includes a junction box 5; optionally a perforated box assembly 10; a heater flange component 20; a bracket assembly 40 that includes an optional upper spine component 41, one or more posts 43 with an optional flow diverter 70 held parallel to one another, at least one conformal bracket 80, and an optional lower spine component 43; one or more heater elements 35; at least one container section component 15, 17; and optionally, at least one temperature sensor 56.

In step 110, the bracket assembly 40 is then assembled with the one or more heater elements 35, such that the post 43 is in contact with the one or more heater elements 35 and optionally with the at least one temperature sensor 56. In step 120, the heater flange component 20 and the at least one container section component 15, 17 are coupled together to form an external shroud/container body 14 that surrounds the one or more heater elements 35 and forms a pathway 30 for the flow of exhaust gas through the heating apparatus 1. In step 115, the junction box 5 and the optional perforated box assembly 10 are then assembled to the heater flange component 20, such that the one or more heater elements 35 are in communication with a power source. In the case where there is one container section component 15 the section component is designed to slide axially over the one or more heater elements 35. In the case, where two or more container section components 15, 17 are utilized, the container section components may be designed to be moved radially into position.

The step of coupling the heater flange component 20 and the at least one container section component 15 may include placing at least one tab 21 located on one selected from the group of the heater flange component 20 and the at least one container section component 15 into a matching hole 22 located in the other component. In addition, when assembled one or more standoff tubes 60 may project through the heater flange component 20 into the external shroud, such that the one or more standoff tubes 60 provide mechanical support for the one or more heater elements 35.

The method 100 may further include attaching a thermowell 55 integrally with the post 43 of the bracket assembly 40, such that the thermowell 55 allows contact between the heater element 35 and the temperature sensor 56 in step 125. The method 100 may also comprise placing a spacer between the posts 43 of the bracket assembly 40 in step 130. Finally, the method 100 may further comprise coupling the one or more heater elements 35 to the posts 43 of the bracket assembly 40 through the conformal bracket 80 in step 135. The conformal bracket 80 is one selected from the group of a rivet or a staple.

The heating apparatus 1 may be utilized in an exhaust system. In addition, the heating apparatus 1 may be assembled according to the methodology described herein followed by the coupling of the heating apparatus 1 into the exhaust system by any means known to one skilled in the art. The exhaust system may include, but not be limited to a diesel exhaust system, a gasoline exhaust system, or a natural exhaust gas system.

A heating apparatus 1 that is small with respect to dimensions may be assembled without the use of posts 43 or U-channel conformal bracket 80. In this case, the heating apparatus does not need the bracket assembly. Thus for small heater systems, the system may comprise: a junction box; optionally, a perforated box assembly; a heater flange component; one or more heater elements; one or more container section components; and optionally, at least one temperature sensor. In this case, the heater flange component is coupled with the one or more container section components, such that they form an external shroud that surrounds the one or more heater elements and establishes a pathway for the flow of exhaust gas through the heating apparatus.

Other Forms of Element Support Component of Bracket Assembly

In the following, various forms of the element support component of the bracket assembly are described. The various forms of the element support component are used to connect the heater element 35 to a container body 14 or a canister wall so that the heater element 35 can be stably disposed in the pathway 30 of the container body 14 and hence the heating apparatus 1. The element support component/mounting bracket and the heater element 35 jointly form a heater assembly.

Referring to FIGS. 12A and 12B, a heater assembly 210 includes a heater element 35 and a mounting bracket 214 for mounting the heater element 35. The mounting bracket 214 has a spider-and-comb configuration and includes a flow diverter 220, a plurality of extension arms 226 and a plurality of comb members 222 attached to the extension arms 226. The extension arms 226 extend radially from and integrally formed with the flow diverter 220. The comb members 222 each include an elongated portion 228 and a plurality of tabs 230. The plurality of tabs 230 extend from the elongated portion 228 along the same plane of the elongated portion 228 and are disposed in the spaces 18 defined between adjacent coiled portions 16 of the heater element 35. The receiving spaces 232 defined between adjacent ones of the tabs 230 tightly hold the coiled portions 16 of the heater element 35 therein to securely keep the heater element 35 in place in the pathway 30 of the heating apparatus 1.

The extension arms 226 each include a mounting tab 34 at a distal end away from the central portion 224 for mounting the heater element 35 to the container body 14 of the heating apparatus 1.

Referring to FIGS. 13A and 13B, a variant of the mounting bracket 240 is similar to that of FIGS. 12A and 12B except for configuration of the extension arms and the comb member. The mounting bracket 240 includes a plurality of extension arms 241 and a plurality of comb members 242 (only one extension arm and one comb member are shown in FIGS. 13A and 13B). The comb members 242 each include a horizontal support 244 extending radially and a plurality of vertical tabs 246 extending vertically from the horizontal support 244. The horizontal support 244 supports the coiled portions 16 of the heater element 35 thereon. The vertical tabs 246 are inserted in the spaces 18 between the coiled portions 16 of the heater element 35 to maintain the position of the coiled portions 16 relative to each other.

In the present embodiment, no weld is needed to assemble the mounting bracket 214 to the heater element 35, although a weld could be employed while remaining within the scope of the present disclosure. The extension arms 226 and the comb members 222 provide high radial strength and high axial strength to support the heater element 35.

Referring to FIGS. 14A and 14B, a variant of a heater assembly 250 includes a mounting bracket 252 and a heater element 35. The mounting bracket 252 has a tuning fork and comb design and includes a flow diverter 254, which in one form is a disc shape as shown, a plurality of fork members 256 attached to the flow diverter 254, and a plurality of comb members 257. The flow diverter 254 defines a plurality of slots 258 for receiving corresponding insertion portions 260 of the fork members 256. The fork members 256 each define an elongated plate body. The elongated plate body is oriented such that the width of the elongated plate body extends in a direction perpendicular to the plane where the coiled portions 16 of the heater element 35 are located and that the thickness of the elongated plate body extends along a circular direction of the coiled portions 16.

Similarly, the comb members 257 each have a plate body having a width extending along a direction perpendicular to the plane where the coiled portions 16 are located and a thickness extending along a circular direction of the coiled portions 16. The mounting bracket in the present embodiment causes less obstruction to the exhaust flow and thus has lower impact on backpressure.

Referring to FIG. 15, a heater assembly 260 includes a mounting bracket 262 and a heater element 35. The mounting bracket 262 includes a central portion 264 functioning as a flow diverter, a pair of first comb members 265, and a plurality of second comb members 266. The pair of first comb members 265 extend diametrically of the heater element 35 and pass through the central portion 264. Preferably, four second comb members 266 are provided to extend from the central portion to a peripheral end of the heater element 212. In FIG. 15, only two second comb members 266 are shown for clarity. The first comb members 265 are longer than the second comb members 266. The first comb members 265 and the second comb members 266 each define a plate configuration having a thickness extending along a circular direction of the coiled portions 16 of the heater element 35.

Referring to FIGS. 16A and 16B, a heater assembly 270 includes a heater element 35 and a mounting bracket 272 for mounting and holding the heater element 35 in the pathway 30 of the heating apparatus 1. The mounting bracket 272 includes a central portion 274 functioning as a flow diverter, a plurality of extension arms 276, and a plurality of worm members 278 corresponding to the plurality of extension arms 276. The worm members 278 each define a plurality of circular portions 279, which, together with the extension arms 276, enclose the coiled portions 16 of the heater element 35. The worm members 278 may be connected to the extension arms 276 by welding, bolting, screwing or any other coupling methods known in the art. These connection or coupling methods may be employed with any of the various forms as set forth herein while remaining within the scope of the present disclosure.

Referring to FIG. 16C, a mounting bracket 280 is similar to the mounting bracket 270 in FIGS. 16A and 16B except for the worm member. A wire weave member 282 is used to replace the worm member 278 of FIGS. 16A and 16B. The wire weave member 282 is attached to the extension arms 276 by inserting the wire weave member 282 into openings 284 in the extension arms 276. The wire weave member 282 reduces wear to the coiled portions 16 of the heater element 35 due to vibration.

Referring to FIG. 16D, the mounting bracket is similar to that of FIG. 16A except that the worm member is replaced with a press-formed inchworm member 288. The inchworm member 288 is press-preformed and can be pressed onto the coiled portions 16 of the heater element 35 by pressing. The inchworm member 288 is welded to the extension arms only at some of the coiled portions 16.

Referring to FIG. 16E, a heater assembly 290 includes a heater element 35, an extension arm 276 and an inchworm member 292 for mounting the heater element 35 to an extension arm 276. The inchworm member 292 has a pair of mounting portions 294 for mounting the inchworm member 292 to the extension arm 276 by welding and a curved portion 296 extending between the mounting portions 294 to define a receiving space 298. The coiled portions 16 of the heater element 35 pass through the receiving space 298 between the curved portion 296 and the extension arms 276.

Referring to FIGS. 17A and 17B, a heater assembly 300 includes a heater element 35 and a mounting bracket 302 for mounting the heater element 35 in the pathway 30 of the heating apparatus 1. The mounting bracket 302 includes a plate body 304 and a comb member 310. The plate body 304 defines a plurality of slots 308 for receiving a plurality of heater elements 35. As shown in FIG. 17A, the plate body 304 has five slots 308. Therefore, up to five heater elements 35 can be installed to the plate body 304 and arranged in a parallel orientation, according to this form. Any number of heaters and slots may be employed, and thus the illustration of five is merely exemplary.

The mounting bracket 302 further includes a plurality of comb members 310 for mounting the plurality of heater elements 35 in the slots 308 of the plate body 304. The comb member 310 includes an elongated body 312, a baffle 316 and a plurality of tabs 318 extending from the elongated body 312 for supporting the coiled portions 16 of the heater element 35. To assemble the heater element 212 to the mounting bracket 302 in one form, the heater element 35 is first mounted to the comb member 310, followed by inserting the comb member 310 into one of the slot 308 of the plate body 304.

Referring to FIG. 17C, a plurality of heater elements 35 may be installed in the mounting bracket so that the plurality of heater elements 35 are arranged in parallel along a flow direction of the exhaust gas.

Referring to FIG. 17D, a variant of a mounting bracket 320 is shown to have a plate body 322 defining a slot 324 and a pair of mounting tabs 326. Instead of using a single bracket plate to install a plurality of heater elements 35 as shown in FIG. 17C, the mounting bracket 320 defines a single slot 324 and allows for installation of a single heater element 35. In one form, the mounting tabs 326 may be welded to an adjacent bracket plate to form a structure similar to that of FIG. 17A.

Referring to FIG. 17E, a heater assembly 30 according to another variant includes a heater element 35, and a bracket assembly including a first bracket plate 332 and a plurality of second bracket plates 334 disposed on opposing sides of the first bracket plate 332. The first bracket plate 332 has a structure similar to that of the bracket plate 304 of FIG. 17A. The second bracket plates 334 are structurally different from the first bracket plate 332 to allow for mounting to the heater flange component, the container body 14, as shown in FIG. 1.

Referring to FIG. 18A, a mounting bracket according to another variant of the present disclosure may be in the form of a cotter pin member 340 for coupling the heater element 35. The cotter pin member 340 may include a flat portion 342 and a wavy portion 344 connected to the flat portion 342 to define a space 346 therebetween. The flat portion 342 and the wavy portion 344 each include a connecting tab 348. The heater element 35 may be disposed in the space 346 between the flat portion 342 and the wavy portion 344.

While not shown in the drawings, it is understood that the flat portion 342 may be replaced with another wavy portion 344 such that both sides of the cotter pin member 340 are wave-formed. Additionally, this design may be used alone or in combination with another conformal bracket described above as an additional stiffener.

Referring to FIG. 18B, a mounting bracket according to another variant may be in the form of ripple arms 350 that are arranged in pair to define a space 152 therebetween. The coiled portions 16 of the heater element 35 are inserted through the space 152. The ripple arms 350 each include a middle flat portion 354 and a pair of ripple portions 356 extending from opposing ends of the middle flat portion 354. The middle flat portion 354 is inserted through the central disk portion (i.e., flow diverter) of the mounting bracket as shown in FIG. 15 so that the ripple portions 356 extending radially from the central disk portion. The ripple portions 356 have ripple configuration for enclosing the coiled portions 16 of the heater element 35. The ripple arms do not have any knife edge to cause wear to the heater element 35.

Referring to FIGS. 19A and 19B, the mounting bracket 380 is shown to have a triangular design and includes a triangular base plate 382 on which the heater element 35 is disposed. Additionally, a rod 383 is employed to compress the coiled portions 16 down into the triangular base plate 382.

Referring to FIGS. 20A through 20D, a heater assembly 390 includes a heater element 35 and a mounting bracket 392. The mounting bracket 392 includes a cross member 394. The cross member 394 are mounted to the heater element 35 in such a way that some of the coiled portions 16 are disposed below the cross member 394 and the other coiled portions 16' are disposed above the cross member 394.

Connecting Features of Mounting Bracket

In the following, the connecting features of the mounting bracket/element support component to the optional upper or lower spine component, the container body, or the heater flange component is described. While the connecting features are described in connection with the mounting bracket of FIGS. 12A and 12B, the connecting features can be embodied in any of the element support component/mounting brackets previously described.

Referring to FIGS. 21A and 21B, the mounting bracket and the heater element 35 described in connection with FIGS. 12A and 12B are shown to be mounted to a container body 400. As previously described, the extension arms each include a mounting tab 34 extending along a thickness direction of the heater element. The container 400 has a peripheral wall 402 defining a vertical slot 204 for receiving the mounting tab 34. The heater assembly 10 is installed to the container body 400 by inserting the mounting tab 34 into the vertical slot 404 of the container body 400.

Referring to FIGS. 22A and 22B, the mounting bracket has a connecting structure in the form of horizontal tabs 410. The horizontal tabs 410 extend in a plane parallel to a plane where the heater element 35 is located, as opposed to the vertical tabs 34 that define a plane vertical to the plane where the heater element 35 is located. The container body 400 includes corresponding horizontal slots 414 for receiving the horizontal tabs 410.

Referring to FIGS. 23A and 23B, the mounting bracket 214 is connected to the container body 400 by an inner ring 420. The inner ring 420 may be an integral part of the mounting bracket 214 or a separate component from the mounting bracket 214. As shown, the extension arms 226 do not form any mounting tabs. Instead, the extension arms 226 have an end defining a shoulder 422. To connect the mounting bracket to the container body 400, the shoulder 422 is disposed against and joined/coupled to the inner ring 420, followed by connecting the inner ring 420 to the container body 400. This structure facilitates assembling the mounting bracket to the container body 400.

Referring to FIGS. 24A and 24B, the interior wall 402 of the container body 400 includes a plurality of inner axial ribs 430 extending along an axial direction. The vertical mounting tabs 34 of the extension arms 226 of the mounting bracket 214 are welded to the axial ribs 430. The vertical mounting tabs 34 are connected to the inner axial ribs 430 by welding, bolting or screws.

The mounting brackets disclosed in any of the embodiments can support the heater elements 35 in the container body 14 or 400 of the heating apparatus 1 to maintain heater element spacing so that a uniform heat transfer within the exhaust gas flow and mixing of the exhaust gas can be achieved. In addition, the mounting bracket also functions as a diffuser for exhaust gas flow, while maintaining structural integrity of the heater element in a high temperature, high vibration/shock environment.

For example, the mounting bracket is configured to have shape that allows for more even temperature distribution within the heated exhaust gas, thereby improving thermal uniformity of the end use component, or to optimize the power density distribution of the heater assembly for improved package size. The mounting brackets are configured to be easily mounted to the heater element to form a heater assembly.

Sensor Installation

Referring to FIG. 25, possible sensor locations on the heater assembly are shown. Heater sheath sensor designs provide temperature feedback for safety limit or process control of the heater assembly in a fluid flow application. The sensor designs should be able to handle a high temperature, high vibration/shock environment while being mounted to the surface of a heater element and being integrated into the heater assembly.

Figure 26A:
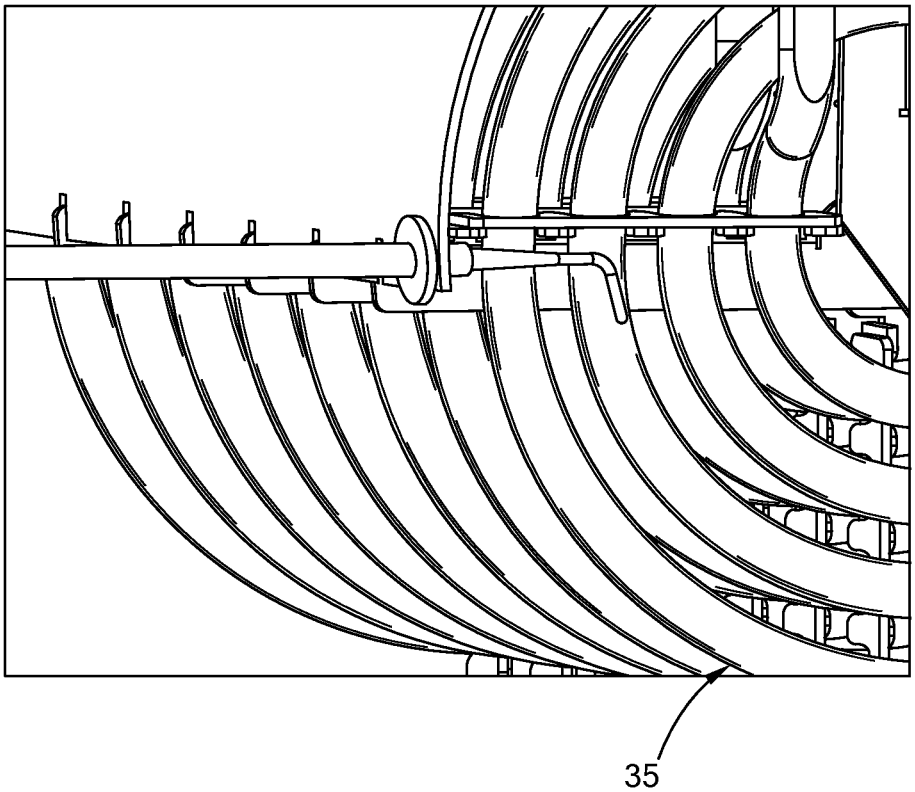

FIG. 26A to FIG. 26E show steps of installing a sheath temperature sensor. Referring to FIG. 26A, sensors are tested before and after welding of the sensors to the heater element 35. The sensors are tested by measuring mV signals. The output should be approximately 1 mV at 25° C. and should rise if heat is applied to the tip. After testing, the sensor is mounted to the heater element 35. In the first step, the hose clamp and the sensor are placed in the heater assembly. In the second step, the tack welded flange is provided at the container to hold the heater assembly in place during final assembly step.

Figure 26B:
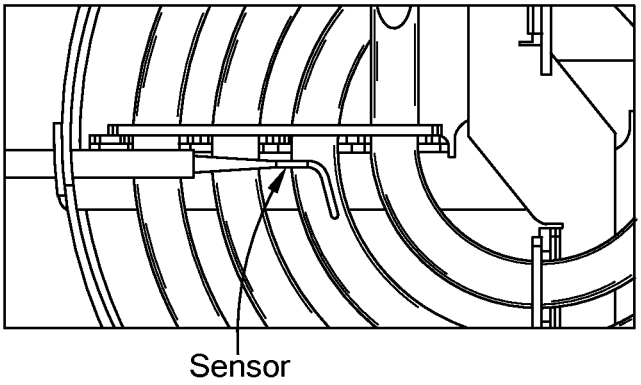
Figure 26C:
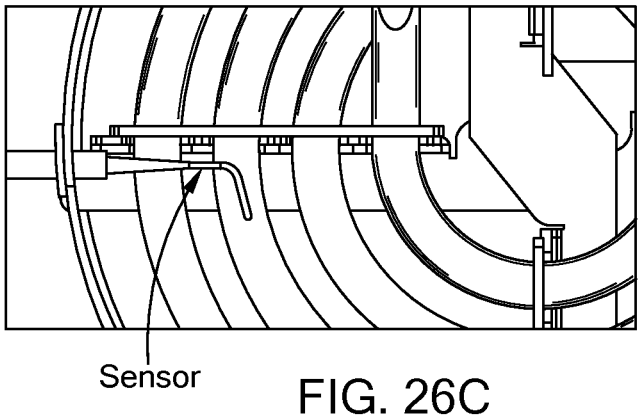
Figure 26D:
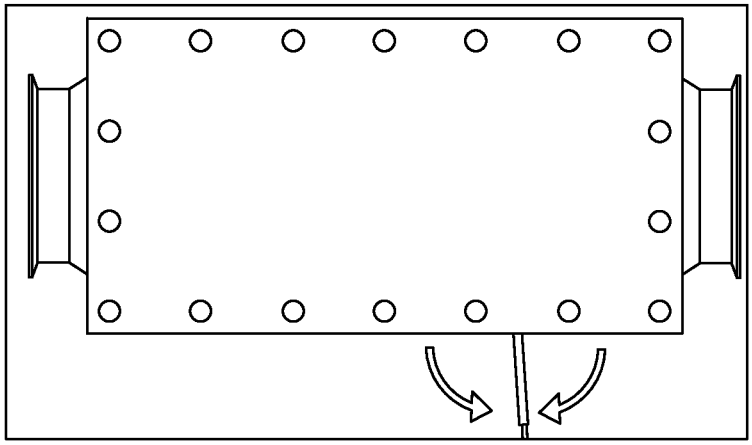
Figure 26E:
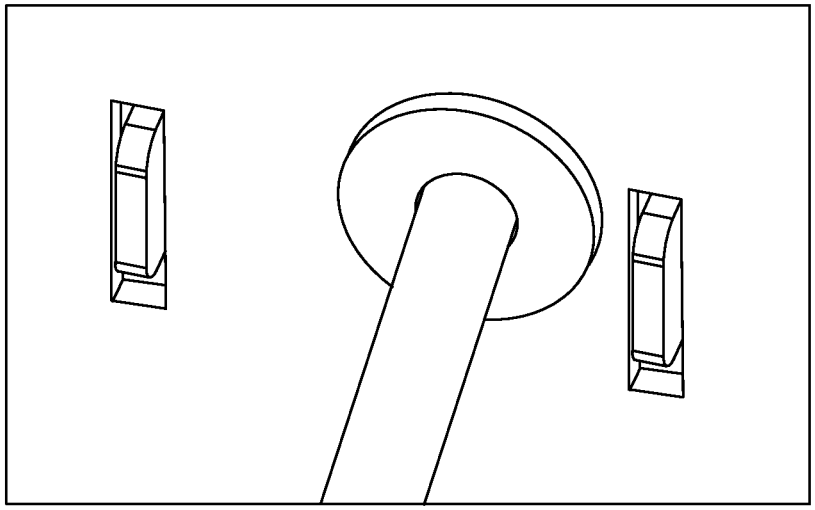

As shown in FIGS. 26B and 26C, the sensor is located on the third coiled portion of the heater element, or the second coiled portion of the heater element. In the final step as shown in FIG. 26E, a final seam weld is formed between the flange and the container and between the flange and the sensor. The flange may be a 304 stainless steel. The outer tube of the sensor may be a 304 stainless steel with 0.032" wall.

Heater Termination

FIG. 27A shows a pop rivet style cold pin connected to a buss bar joint. The heater element includes a cold pin exposed outside the outer sheath of the primary heating portion. The cold pin may be snapped into the buss bar to form a buss bar joint. FIG. 27B shows the pop rivet style cold pin is connected to the buss bar joint after the cold pin is snapped into the buss bar. FIG. 27C shows a flexible cold pin termination. FIG. 27D shows a termination buss for a formed cold pin. The heater termination designs allow the heater assembly to be used in a high vibration environment while allowing for ease of high volume manufacturing. The termination design may incorporate cold forming of a heater element cold pin into a buss bar or other easily assembled types of designs.

Referring now to FIGS. 28A and 28B, additional forms of conformal brackets are illustrated and generally indicated by reference numerals 500 and 600. First, a conformal arm bracket 500 is shown, wherein the previously described conformal bracket includes an arm 510 extending from the conformal portion 520 as shown. This arm 510 is secured an interior portion of the can or component of the thermal management application (not shown), and preferably only at one end of the can. Another form of a conformal arm bracket is shown as 600, which includes a conformal staple 610 disposed within a slot 620 of an arm 630. Similarly, the arm 630 is secured an interior portion of the can or component of the thermal management application (not shown), and preferably only at one end of the can.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A heating apparatus for an exhaust gas system, the heating apparatus comprising:

a container body defining an exhaust gas pathway;

a heater flange component attached to an exterior of the container body, wherein the heater flange component and the container body define corresponding mating portions therebetween, the mating portions connecting the heater flange component to the container body;

a heater assembly disposed in the exhaust gas pathway and secured to the heater flange component, the heater assembly including:

at least one heater element;

a bracket assembly that secures the at least one heater element in the container body; and a conformal bracket for securing the at least one heater element to the bracket assembly;

a junction box mounted on the heater flange component, the junction box including one or more electrical terminals that connect the at least one heater element to a power source; and a perforated box assembly disposed between the heater flange component and the junction box to allow for air cooling of the junction box, wherein the perforated box assembly includes one or more side walls that have a plurality of holes defined therethrough, and the at least one heater element extends through the perforated box assembly to connect to the one or more electrical terminals.

2. The heating apparatus according to claim 1, wherein one of the heater flange component and the container body includes a plurality of tabs and the other one of the heater flange component and the container body defines a plurality of holes corresponding to the plurality of tabs, the heater flange component being attached to the container body by inserting the plurality of tabs into the plurality of holes.

3. The heating apparatus according to claim 1, wherein the bracket assembly includes at least one post that secures the heater element to the container body.

4. The heating apparatus according to claim 1, wherein the conformal bracket defines a U-channel.

5. The heating apparatus according to claim 1, wherein the conformal bracket is selected from the group consisting of a rivet assembly and a staple member.

6. The heating apparatus according to claim 1, wherein the bracket assembly further includes a flow diverter.

7. The heating apparatus according to claim 6, wherein the flow diverter defines a disc disposed at a middle portion of the post.

8. The heating apparatus according to claim 1 further comprising a thermowell connected to the bracket assembly.

9. The heating apparatus according to claim 8 further comprising a temperature sensor disposed within the thermowell and exposed to exhaust gas.

10. The heating apparatus according to claim 1, further comprising one or more standoff tubes in the perforated box assembly for protecting a portion of the heater element extending therethrough.

11. The heating apparatus according to claim 10, wherein the standoff tubes are brazed to the heater flange component using nickel or copper.

12. The heating apparatus according to claim 1, wherein the container body comprises at least two separable container section components, and the heater flange component is coupled with the at least two separable container section components such that they form an external shroud that surrounds the one or more heater elements and establishes a pathway for the flow of exhaust gas through the heating apparatus.

13. The heating apparatus according to claim 1, wherein the heater flange component defines a plate portion, one of the mating portions extending from the plate portion.

14. The heating apparatus according to claim 13, wherein the plate portion of the heater flange component includes two edges parallel to a longitudinal direction of the container body, the one of the mating portions extending from the two edges of the plate portion of the heater flange component.

15. The heating apparatus according to claim 14, wherein the one of the mating portions includes a plurality of tabs extending from the two edges of the plate portion of the heater flange component.

16. The heating apparatus according to claim 1, wherein the container body defines two opposing edges extending along a longitudinal direction of the container body, the two opposing edges defining an opening therebetween, the heater flange component being disposed between the two opposing edges and covering the opening.

17. The heating apparatus according to claim 16, wherein the corresponding mating portions are disposed along the two opposing edges of the container body.

18. The heating apparatus according to claim 17, wherein the heater flange component includes a plurality of tabs disposed along the two opposing edges of the container body.

19. A heating apparatus for an exhaust gas system, the heating apparatus comprising:

a container body defining an exhaust gas pathway;

a heater flange component attached to the container body along an axis perpendicular to the exhaust gas pathway;

a heater assembly disposed in the exhaust gas pathway and secured to the heater flange component, the heater assembly including:

at least one heater element; and a bracket assembly that secures the at least one heater element to the container body;

a junction box mounted on the heater flange component such that the heater flange component is disposed between the junction box and the container body, wherein the junction box includes at least one electrical terminal that connects the at least one heater element to a power source; and a perforated box assembly disposed between the heater flange component and the junction box to allow for air cooling of the junction box, wherein the at least one heater element extends through the heater flange component and the perforated box assembly to connect to the terminals of the junction box.

20. The heating apparatus according to claim 19 further comprising a conformal bracket for securing the at least one heater element to the bracket assembly.

21. The heating apparatus according to claim 19, wherein one of the heater flange component and the container body includes a plurality of tabs and the other one of the heater flange component and the container body defines a plurality of holes corresponding to the plurality of tabs, wherein the heater flange component is attached to the container body by inserting the plurality of tabs into the plurality of holes.

22. The heating apparatus according to claim 19, further comprising at least one standoff tube disposed in the perforated box assembly to protect a portion of the at least one heater element extending therethrough.

23. The heating apparatus according to claim 22, wherein the standoff tubes are brazed to the heater flange component using nickel or copper.

* * * * *